US007458655B2

(12) United States Patent
Takahashi et al.

(10) Patent No.: US 7,458,655 B2
(45) Date of Patent: Dec. 2, 2008

(54) PRINTING APPARATUS, PRINTING POSITION ADJUSTMENT VALUE SETTING METHOD AND PRINTING METHOD

(75) Inventors: Kiichiro Takahashi, Kanagawa (JP); Naoji Otsuka, Kanagawa (JP); Osamu Iwasaki, Tokyo (JP); Minoru Teshigawara, Kanagawa (JP); Satoshi Seki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 385 days.

(21) Appl. No.: 10/929,450

(22) Filed: Aug. 31, 2004

(65) Prior Publication Data

US 2005/0052481 A1 Mar. 10, 2005

(30) Foreign Application Priority Data

Sep. 4, 2003 (JP) ..... 2003-313177

(51) Int. Cl.
*B41J 29/393* (2006.01)

(52) U.S. Cl. ..... 347/19; 347/104; 347/14

(58) Field of Classification Search ..... 347/19
See application file for complete search history.

(56) References Cited

U.S. PATENT DOCUMENTS 6,371,592 B1 * 4/2002 Otsuka et al. ..... 347/19
6,416,151 B1 7/2002 Otsuka et al.
6,454,390 B1 9/2002 Takahashi et al.
6,474,767 B1 11/2002 Teshigawara et al.
6,634,819 B2 * 10/2003 Uchida ..... 400/691
2002/0158936 A1 10/2002 Otsuka et al.
2004/0046813 A1 3/2004 Edamura et al.

FOREIGN PATENT DOCUMENTS

JP 11-291470 10/1999
JP 11-291477 10/1999
JP 11-291553 10/1999

* cited by examiner

*Primary Examiner*—Matthew Luu
*Assistant Examiner*—Brian J Goldberg
(74) *Attorney, Agent, or Firm*—Fitzpatrick, Cella, Harper & Scinto

(57) ABSTRACT

An adjustment value applicable to the adjustment of a printing position is obtainable by reading a printing position adjustment pattern printed on a printing medium without requiring the manual operation by the operator. Furthermore, the printing position can be optimally adjusted by accurately scanning the printing position adjustment pattern. For this purpose, an optical sensor is located in the vicinity of the printing head, and the optical sensor is situated near a predetermined position side. The predetermined position side is a pinch roller side where a large restrictive force acts to the printing medium with the printing position adjustment pattern printed thereon.

9 Claims, 17 Drawing Sheets

PRINTING APPARATUS, PRINTING POSITION ADJUSTMENT VALUE SETTING METHOD AND PRINTING METHOD

BACKGROUND OF THE INVENTION

1. Field of the Invention

The present invention relates to a printing apparatus, a printing position adjustment value setting method and a printing method respectively designed so that the printing position adjusting pattern printed on each printing medium is scanned by an optical sensor to determine the adjusting value to be applied in adjusting the printing position.

2. Description of the Related Art

In recent years, with the spread of the personal computers and the digital cameras, the technologies relating to various printing apparatuses (the various types of printers) and the technologies for speeding the operation of such printing apparatuses and the technologies for obtaining the prints of higher quality have been developed rapidly. Among these printing apparatuses, the serial-type printing apparatus of a dot matrix printing method is coming to the fore as a printing apparatus capable of realizing the high-quality image printing at low cost and high speed. Among the printing methods adopted for such a high-speed printing, there is, for example, a 2-way printing method, while among the printing methods for the high-quality image printing, there is, for example, a multi-scanning printing method.

In the case of the dot matrix printing method, it is necessary to adjust the position for depositing the ink on the printing medium in order to obtain a high-quality printed image. Hence, the technology for the registration of the print (the printing position adjustment), that is, a technology of a dot alignment process for adjusting the deposit position of the ink is necessary. The dot alignment process is a process for determining the adjusting value for adjusting the position whereon the ink dot is to be deposited (i.e., the printing position) sometimes including the process for controlling the printing process while adjusting the printing position according to the determined adjusting value.

Conventionally, this kind of registration process in printing (i.e., the printing position adjustment) has been practiced as described in the following.

For instance, in the case of the 2-way printing method characterized by the forward and the backward scanning processes, the rule mark, as a position adjusting pattern, is printed on the printing medium so that the printing position adjusting value can be determined on the basis of the printing rule mark. More specifically, firstly the timing of the printing for the forward scanning and the timing for the backward scanning are adjusted to each other, and the relative position adjustment conditions between the forward scanning and the backward scanning are varied to print the rule marks on the printing medium. Each user or the operator (of the printing apparatus) observes the printed rule marks for the forward scanning and the backward scanning to select the optimal printing conditions for the best combination of the printing position during the forward scanning and the printing position during the backward scanning. Then, the optimal printing conditions are set with the printer or the host computer.

When using a plurality of printing heads for ejecting the printing inks respectively, the relative positions of the ink ejecting nozzles of different printing heads are determined as described in the following. First, the relative printing position adjustment conditions among different printing heads are varied (from one another) to print the rule marks, as being the printing position adjustment patterns. Each user or operator checks the printed rule marks to select the optimal (combination of) the printing conditions best matching with one another for the printing by the plurality of printing heads. Then, the optimal (combination of) the printing conditions are set with the printer or the host computer.

The Japanese Patent Application Laid-open No. 11-291470(1999) and the Japanese Patent Application Laid-open No. 11-291553(1999) disclose an automatic dot alignment process respectively. These processes are designed for automatically align the printing positions during the forward scanning of the printing head with the printing positions during the backward scanning of the printing head by using an optical sensor and without requiring the manual operation by the user or the operator. Further, the Japanese Patent Application Laid-open No. 11-291477(1999) discloses a structure for defining the relative positions of the printing head and the optical sensor in consideration of the processing time and the optical characteristic.

Such conventional printing position adjustment methods, however, require the user or the operator to select the printing position adjusting conditions by checking the result of the print and by following the cumbersome procedure in many instances. Thus, it is possible that the users who are not willing to follow such a cumbersome steps may use the printer even omitting the registration between the print made by the forward scan and the print made by the backward scan or omitting the correction of the disagreement among the prints made by a plurality of printing heads.

Further, in the case of the conventional print registration methods, the print registration conditions can be selected only from among those corresponding to the printed registration adjustment patterns. Thus, in order for the operator to seek the print registration of higher accuracy, for example, it is necessary to print as may number of patterns corresponding to finely varied print registration conditions as possible, so that the users are required to distinguish such fine differences of the patterns in selecting and setting desired print registration conditions. Such procedure may not be so cumbersome to the experienced users of the printing apparatuses, but it can be so cumbersome and time-consuming to the ordinary users thereby subjecting such users to some intolerable mental burden in the worst case.

On the other hand, when applying the automatic dot alignment process by using the optical sensor, firstly the adjustment patterns for the print registration are printed on the printing medium so as to be read out later by the optical sensor. Then, the best adjustment pattern for the best print registration needs to be determined. Hence, it is necessary that all of the necessary adjustment patterns be printed on the printing medium. Further, even where the adjustment patterns have been printed once, there occurs sometimes that the optical characteristic, such as the printing density of the adjustment pattern, cannot be read correctly depending on the condition of the printing medium thereby making it impossible to attain the desired dot alignment correctly. For instance, when the inkjet printing method, designed to eject the ink droplets from the printing head, the ink droplets are absorbed by the printing medium, so that there is the possibility that the shape of the printing medium varies in the process of drying. To be more specific, there can occur the cockling or the curling of the printing medium. In such an event, the optical characteristic of the printed adjustment pattern is subject to vary depending on the conditions wherein the printing operation takes place or the kind of the printing medium or the kind of ink to be used.

SUMMARY OF THE INVENTION

The object of the present invention is to provide a printing apparatus capable of obtaining an adjustment values for adjusting a printing position by reading a printing position adjustment pattern printed on a printing medium, without requiring the manual operation of the user, and capable of optimally adjusting the printing position by accurately reading the printing position adjustment pattern printed on the printing medium, a method for setting the printing position adjustment value and a printing method.

In the first aspect of the present invention, there is provided a printing apparatus for printing on a printing medium by using a printing head for applying ink on the printing medium, the apparatus comprising:

a pattern printing control means for printing a predetermined pattern on the printing medium;

an optical sensor located in the vicinity of the printing head in order to read the predetermined pattern printed on the printing medium, a positioning means for positioning the printing medium to a printing position by the printing head and a reading position by the optical sensor; and an adjustment value setting means for setting an adjustment value for adjusting a applying position of the ink to be applied from the printing head based on a result of the reading by the optical sensor, wherein the optical sensor is situated near a predetermined position side relative to the printing head, the predetermined position side having a relatively large restrictive force which is generated from the positioning means to restrict a displacement of the printing medium toward the optical sensor side caused by printing the predetermined pattern.

In the second aspect of the present invention, there is provided a printing position adjustment value setting method applicable to a printing apparatus for printing on a printing medium by using a printing head for applying ink on the printing medium, the method setting an adjustment value for adjusting a printing portion of the printing head, the method comprising the steps of:

printing a predetermined pattern on the printing medium by using the printing head, after positioning the printing medium to a position opposite to the printing head;

reading the predetermined pattern printed on the printing medium by a optical sensor located in a vicinity of the printing head, after positioning the printing medium to a position opposite to the optical sensor;

setting the adjustment value for adjusting a applying position of the ink to be applied from the printing head based on a result of the reading by the optical sensor, wherein the optical sensor is situated near a predetermined position side relative to the printing head, the predetermined position side having a relatively large restrictive force which is generated from the positioning means to restrict a displacement of the printing medium toward the optical sensor side caused by printing the predetermined pattern.

In the third aspect of the present invention, there is provided a printing method for printing on a printing medium by using a printing head for applying ink on the printing medium, comprising the steps of:

printing a predetermined pattern on the printing medium by using the printing head, after positioning the printing medium to a position opposite to the printing head;

reading the predetermined pattern printed on the printing medium by a optical sensor located in a vicinity of the printing head, after positioning the printing medium to a position opposite to the optical sensor;

setting the adjustment value for adjusting a printing position of the printing head, and performing the printing after adjusting a applying position of the ink to be applied from the printing head on the basis of the adjustment value set by the setting step, wherein the optical sensor is situated near a predetermined position side relative to the printing head, in the predetermined position side having a relatively large restrictive force which is generated from the positioning means to restrict a displacement of the printing medium toward the optical sensor side caused by printing the predetermined pattern.

In the present invention, the location of the optical sensor is set in consideration of the change in the condition of the printing medium occurring when the printing position adjustment pattern to be read by the optical sensor is printed on the printing medium. More particularly, the location of the optical sensor is offset towards the predetermined location relative to the printing head, that is, the location where the controlling force acts best on the printing medium. In this way, the effect of the cockling or curling of the printing medium that can occur in the drying process of the ink deposited on the printing medium for printing the printing position adjustment pattern can be avoided. By so doing, the accuracy in reading the printing position adjustment pattern by the optical sensor can be raised to realize the printing position adjustment with higher accuracy.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Next, the embodiments of the present invention will be described referring to pertinent drawings.

(1) Basic Composition

First, the basic construction of an inkjet printing apparatus according to the present invention will be described. Here, an example of the inkjet printing type printer (an inkjet printer) will be described.

(1-1) Body of Apparatus

Figure 2:
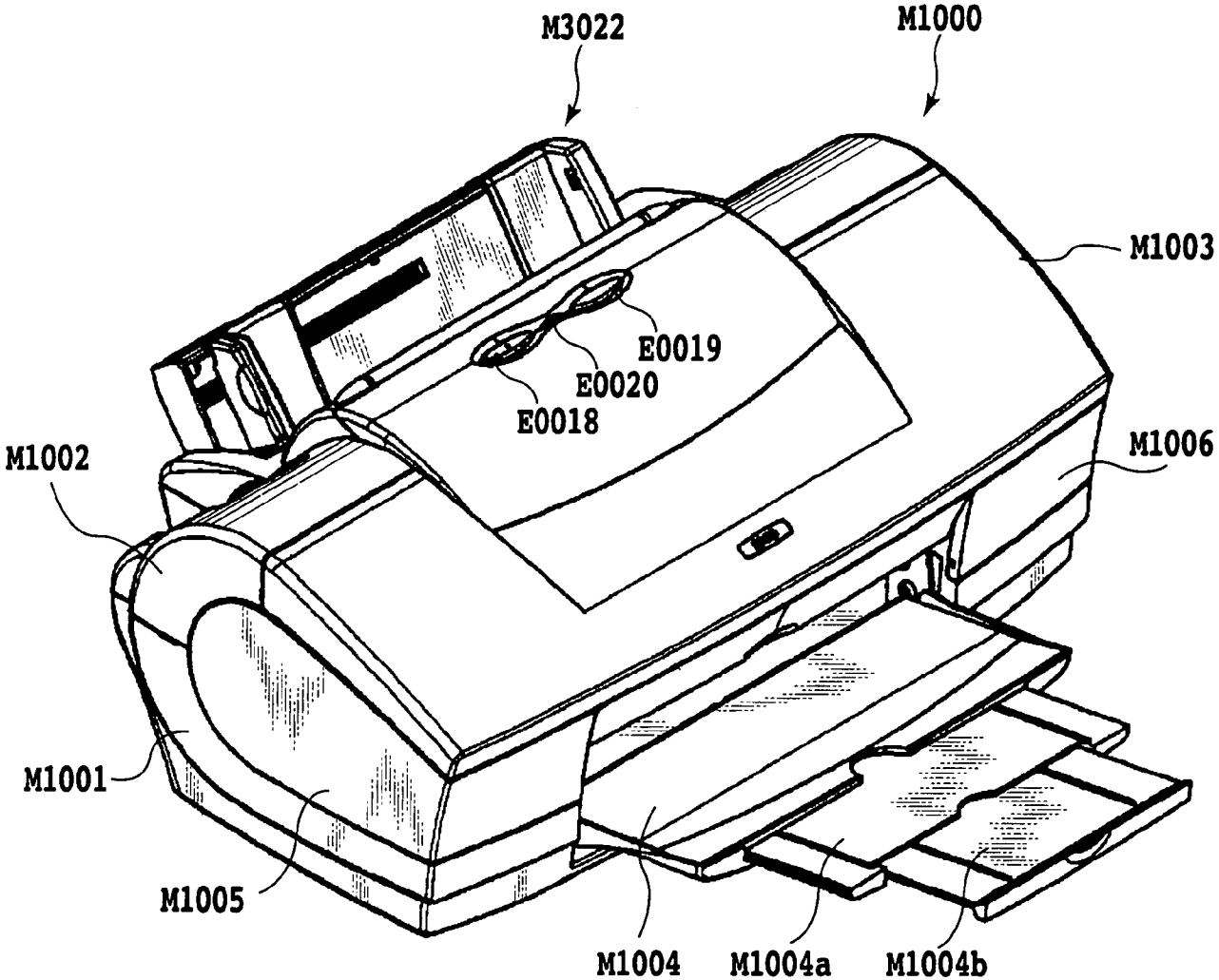
FIG. 2 is a general external view of the inkjet printing apparatus shown in FIG. 1.
Figure 3:
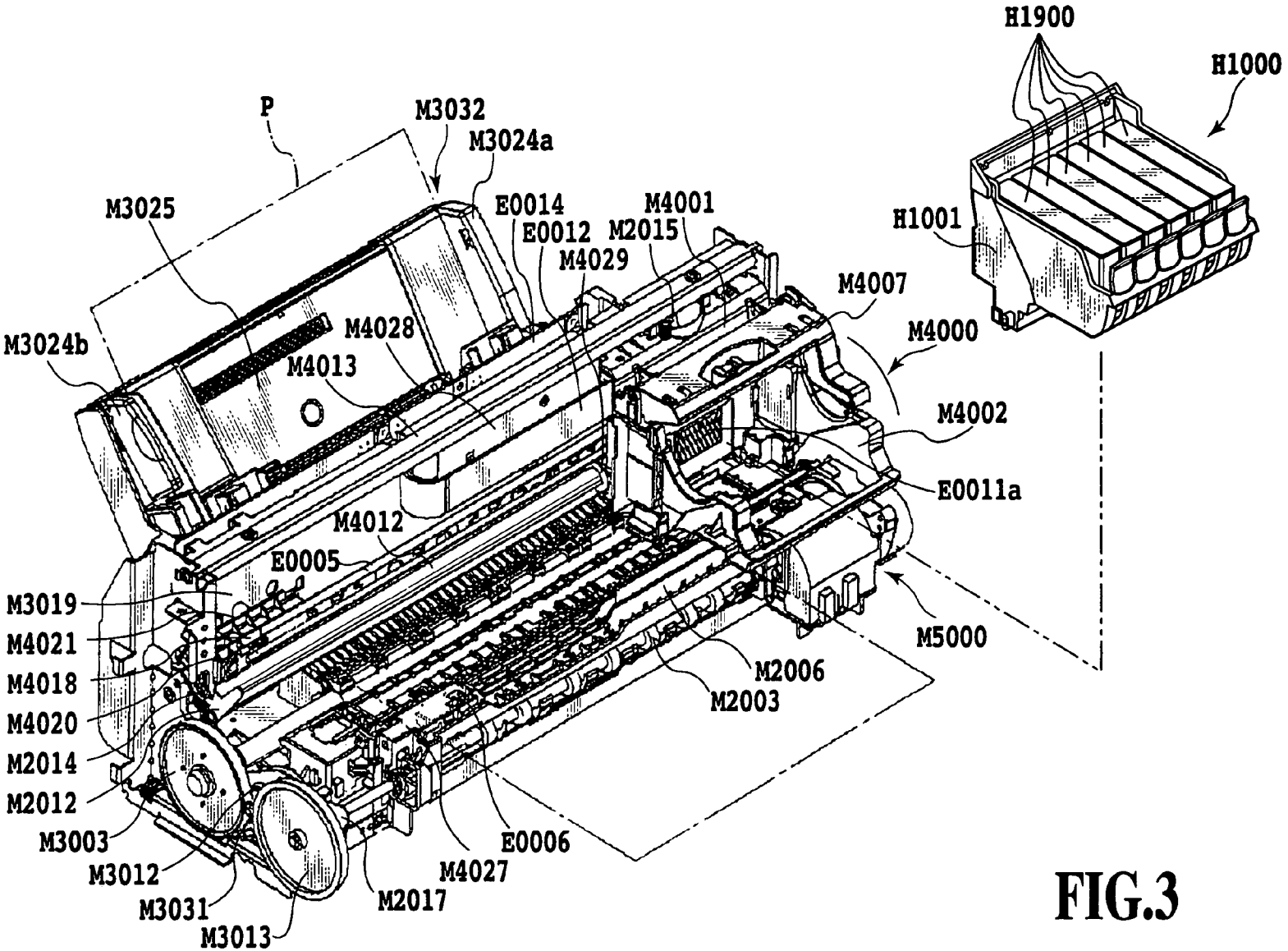
FIG. 3 is a perspective view of the inkjet printing apparatus as is shown in FIG. 2 but not showing the external members thereof.

FIG. 2 shows an external view of the inkjet printer as an embodiment of the present invention; FIG. 3 is a perspective view of the inkjet printer as shown in FIG. 2 but with the external members thereof removed.

Referring to FIG. 2 and FIG. 3, an body M1000 comprising an outer casing of the inkjet printer includes outer members, namely a bottom casing M1001, an upper casing M1002 and an access cover M1003, a paper discharge tray M1004, a front cover (L) M1005 and a front cover (R) M1006, and a chassis M3019 in the outer members. The paper discharge tray M1004 contains 2 pieces of auxiliary trays M1004*a* and M1004*b*. When necessary these auxiliary trays M1004*a* and M1006*b* can be pulled out towards the operator in 3 stages to increase the supporting area of the discharged sheets of paper.

The access cover M1003 has one end thereof pivotally supported by the upper casing M1002 so as to be capable of being turned round its axis of rotation to provide an opening at the top of the body M1000 of the printing apparatus. The access cover M1003 can be opened when replacing a printing head cartridge H1000 of or an ink tank H1900 or the like.

The upper casing M1002 has a pushbutton (a power key) for power source E0018, a resume pushbutton (a resume key) E0019 and a light-emitting diode (LED) E0020 provided on the rear top surface thereof. When the power key E0018 is pressed for making printer ready for printing operation, LED E0020 will be lighted to let the operator know that the printing apparatus is ready for printing operation. Besides, there are provided various indicating functions such as one designed for varying the on-off mode and the indication color of the LED E0020 or for sounding a buzzer for telling the operator that the printing operation cannot be continued owing to the occurrence of the trouble in the printer or the like. Furthermore, when the trouble is removed, the printing operation can be resumed by pressing the resume key E0019.

(1-2) Printing Mechanism

Figure 1:
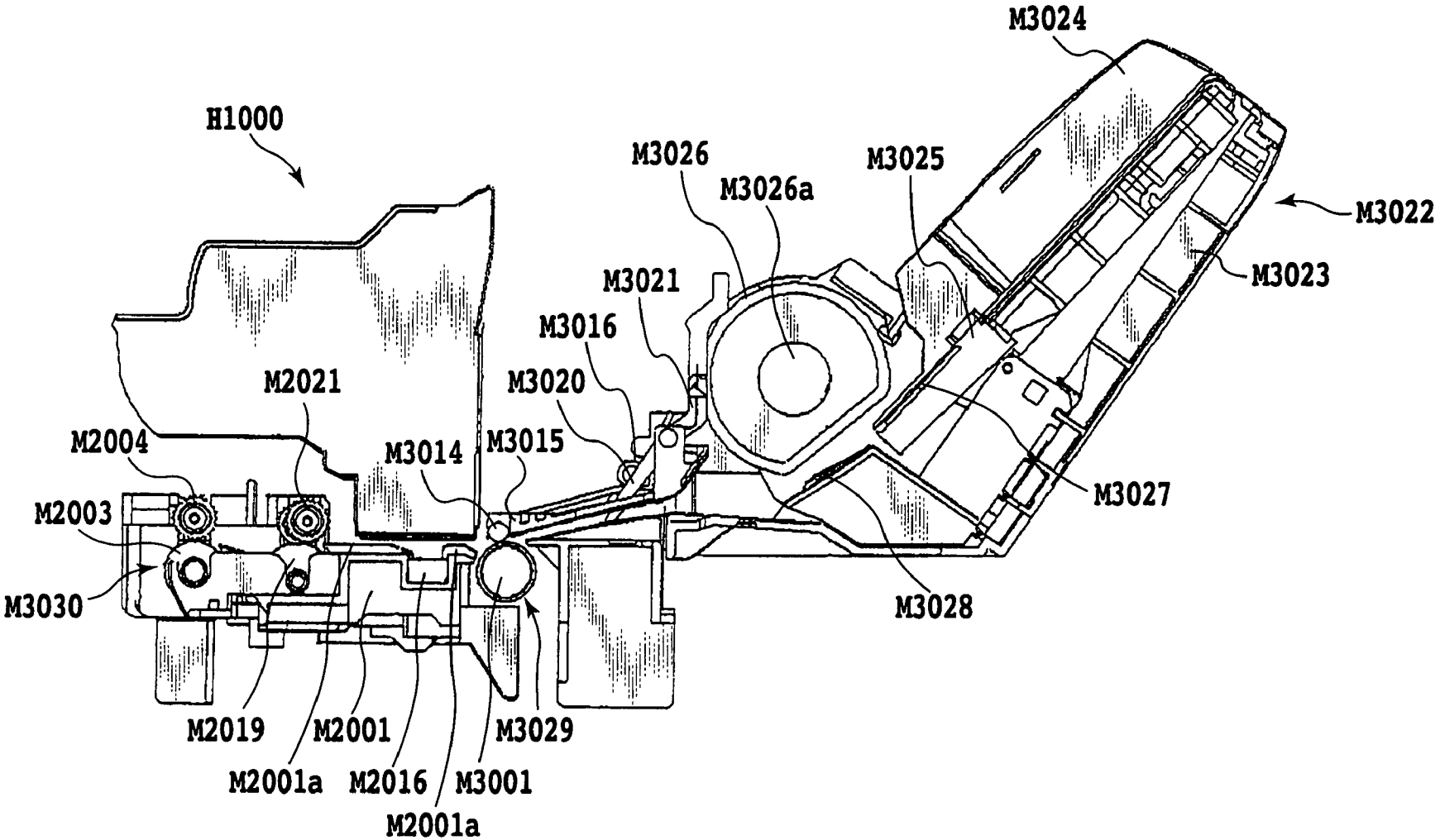
FIG. 1 is a side view schematically illustrating the internal construction of the inkjet printing apparatus as the first embodiment of the present invention.

Next, the printing mechanism contained in the above-mentioned body M1000 of the printing apparatus will be described. FIG. 1 is a side view illustrating the internal composition of the inkjet printer as is shown in FIG. 2. The illustration in the following will be made referring to FIG. 1 and FIG. 3.

This printing mechanism comprises an automatic supplying portion M3022, a feeding portion M3029, a printing portion M4000 and a recovery portion M5000. The automatic supplying M3022 automatically supplies a printing sheet P into the body M1000 of the printing apparatus. The feeding portion M3029 guides each printing sheet P, released one by one from the automatic supplying portion M3022, not only to the predetermined printing position but also to the paper discharging portion M3030 from the printing position. The printing portion M4000 is mounted with a printing head H1001 for making the desired printing on the printing sheet P transferred by the feeding portion M3029. The recovery portion M5000 performs the recovery operation for the printing head H1001.

The compositions of various mechanisms will be described specifically in the following.

(1-2a) Automatic Supplying Portion

The automatic supplying portion M3022 horizontally releases each sheet of paper P from a pack of paper, loaded at an angle within 30° to 60° to the horizontal plane, into the printing apparatus through a paper supplying opening (not shown). The automatic supplying portion M3022 comprises a supplying roller M3026, a movable side guard M3024, a pressure plate M3025, an ASF base M3023, a separation sheet M3027 and a separation pad M3028 or the like as shown in FIG. 1 and FIG. 3.

The AFS base M3023 substantially constitutes the outer casing of the automatic supplying portion M3022 and is provided behind the body of the printing apparatus. On the front side of the AFS base M3023 the pressure plate M3025 to support the printing sheet P is provided at angles ranging from 30° to 60° to the horizontal plane; the AFS base M3023 is provided with a pair of projecting sheet guides M3024*a* and M3024*b* for guiding the sides of the printing sheet P. The sheet guide M3024*b* is designed to be movable horizontally corresponding to the horizontal size (width) of the printing sheet P.

A drive shaft M3026*a*, connected with an ASF motor for being driven through a transmission gear train (not shown), is movably supported at the left-hand side and the right-hand side of the ASF base M3023. The drive shaft M3026*a* is provided with a plurality of paper feeding rollers M3026 having different peripheral shapes.

The printing sheets P loaded on the pressure plate M3025 are fed one by one owing to the rotation of the supplying roller M3026 and the separating action created by the cooperation between the separation sheet M3027 and the separation pad M3028. More specifically, the loaded printing sheets P is fed to the feeding portion M3029 one by one from the topmost sheet.

In the transfer path from the automatic supplying portion M3022 to the feeding portion M3029, there is provided a PE lever M3020 forced towards the predetermined direction (in counterclockwise direction in FIG. 1) with a PE lever spring M3021. The PE lever M3020 is pivotally mounted with a pinch roller holder M3015, while the pinch roller holder M3015 is fixed to a chassis M3019 formed from a metal sheet having a predetermined rigidity. Then, a printing sheet released from the automatic supplying portion M3022 advances on the transfer path to let the PE lever M3020 turn by pushing one end thereof. When the turn of the PE lever M3020 is detected by a PE sensor (not shown), it is detected that the printing sheet P has advanced into the transfer path. After the entry of the printing sheet P into the transfer path is detected, the printing sheet P is transferred towards the downstream side by a predetermined amount by the supplying roller M3026. The supplying action of the supplying roller M3026 causes the front end of the printing sheet P to come into contact with the nipping portion between the LF roller M3001 and a pinch roller M3014 and stop while being warped by a predetermined amount. In this case, the amount of the warp (or the size of the loop) is, for example, about 3 mm.

(1-2b) Feeding Portion

The feeding portion M3029, as is shown in FIG. 1 and FIG. 3, comprises the LF roller M3001, the pinch roller M3014, a platen M2001, a platen absorber M2016 or the like. The LF roller M3001 is pivotally supported with the chassis M3019 through a bearing (not shown).

The LF roller M3001 has an LF gear M3003 fixed to one end thereof; the LF gear M3003 engages with an LF motor gear M3031, fixed to the output shaft of the LF motor through an LF intermediate gear M3012. The rotation of the LF motor causes the LF roller M3001 to rotate through gear trains engaging with each other.

The pinch roller M3014 is pivotally attached to an end of a pinch roller holder M3015, which is pivotally supported with the chassis M3019. Further, the pinch roller M3014 is forced to be in contact with the LF roller M3001 by means of a winding-spring-type pinch roller spring M3016. The rotation of the LF roller M3001 causes the pinch roller M3014 to rotate. This further causes the printing sheet P, kept standing still in warped state as described previously, is fed towards the downstream side while being pinched between the LF roller M3001 and the pinch roller M3014.

The center of the rotation of the pinch roller M3014 is offset by about 2 mm from the center of the rotation of the LF roller M3001 towards the downstream side in the direction of the transfer. In this way, the printing sheet P is fed in the lower leftward direction as is shown in FIG. 1 by means of the LF roller M3001 and the pinch roller M3014 and is further fed along a printing sheet supporting plane M2001*a* of the platen M2001.

With the feeding portion composed as described above, after the elapse of a predetermined time from the stop of the feeding operation of the feeding roller M3026 of the automatic feeding portion M3022, the LF motor starts to be driven. In this way, the drive of the LF motor is transmitted to the LF roller M3001 through the LF intermediate gear M3012 and the LF gear M3003. In consequence, the printing sheet P, whose front end is in contact with the nipping portion between the LF roller M3001 and the pinch roller M3014, is fed to the printing start position on the platen M2001 by the effect of the rotation of the LF roller M3001.

In the course of such a feeding, the feeding roller M3026 and the LF roller M3001 start to rotate simultaneously, whereby, through the cooperation between the feeding roller M3026 and the LF roller M3001, the printing sheet P is fed towards the downstream side during a predetermined time period. The both ends of carriage shaft M4012 are fixed to the chassis M3019, and a carriage M4001 moves back and forth in the primary scanning direction, intersecting the direction of the transfer of the printing sheet P, (i.e., the direction orthogonal to the transfer direction in the present embodiment) along the carriage shaft M4012. The printing head cartridge H1000 moves together with the carriage M4001 to print the image with the ink according to the predetermined image information by ejecting (applying) the ink onto the printing sheet P standing still at the print starting position.

After printing the image with the ink by the scanning operation of the printing head cartridge H1000, the rotation of the LF roller M3001 causes the printing sheet P to be transferred by the amount, for example, corresponding to the line interval of 5.42 mm. Upon completion of the transfer operation, the carriage M4001 resumes to travel along the carriage shaft M4012 for the scanning with the printing head cartridge H1000 to print the image with the ink. Repeating such printing operation and transfer operation ends up with the print of the desired image with the ink onto the printing sheet P placed on the platen M2001.

One end of the carriage shaft M4012 is forced against a paper sheet interval adjusting plate (R) (not shown) by means of a carriage shaft spring M2014, while the other end thereof is forced against an other paper sheet interval adjusting plate (L) M2012 by the carriage shaft spring M2014. The interval adjusting plates are designed to properly set the interval between the ejecting face (whereon the ink ejection openings are formed) of the printing head cartridge H1000 and the printing sheet supporting face M2001*a* of the platen M2001 and are fixed to the chassis M3019.

An interval adjusting lever M2015 can selectively be set to 2 stop positions, i.e., the left-hand side stop position as shown in FIG. 3 and the right-hand side stop position (not shown). If the interval adjusting lever M2015 is shifted to the right-hand side position, the carriage M4001 retreats to the position about 0.6 mm away from the platen M2001. Thus, if the printing sheet is as thick as an envelope, the paper feeding operation by the automatic feeding portion M3022 should be started after shifting the interval adjusting lever M2015 to the right-hand side position.

Further, when the interval adjusting lever M2015 is shifted to the right-hand side position, the position of the interval adjusting lever M2015 is detected by a GAP sensor. When the feed of the printing sheet P by the automatic feeding portion M3022 is to be started, whether the setting of the interval adjusting lever M2015 is properly made or not is determined on the basis of an output of the GPA sensor, and, when the setting is found to be improper, an alarm is given by a warning message or the buzzer. In this way, the printing operation can be prevented from being performed in any undesirable condition.

(1-2c) Paper Discharging Portion

Figure 4:
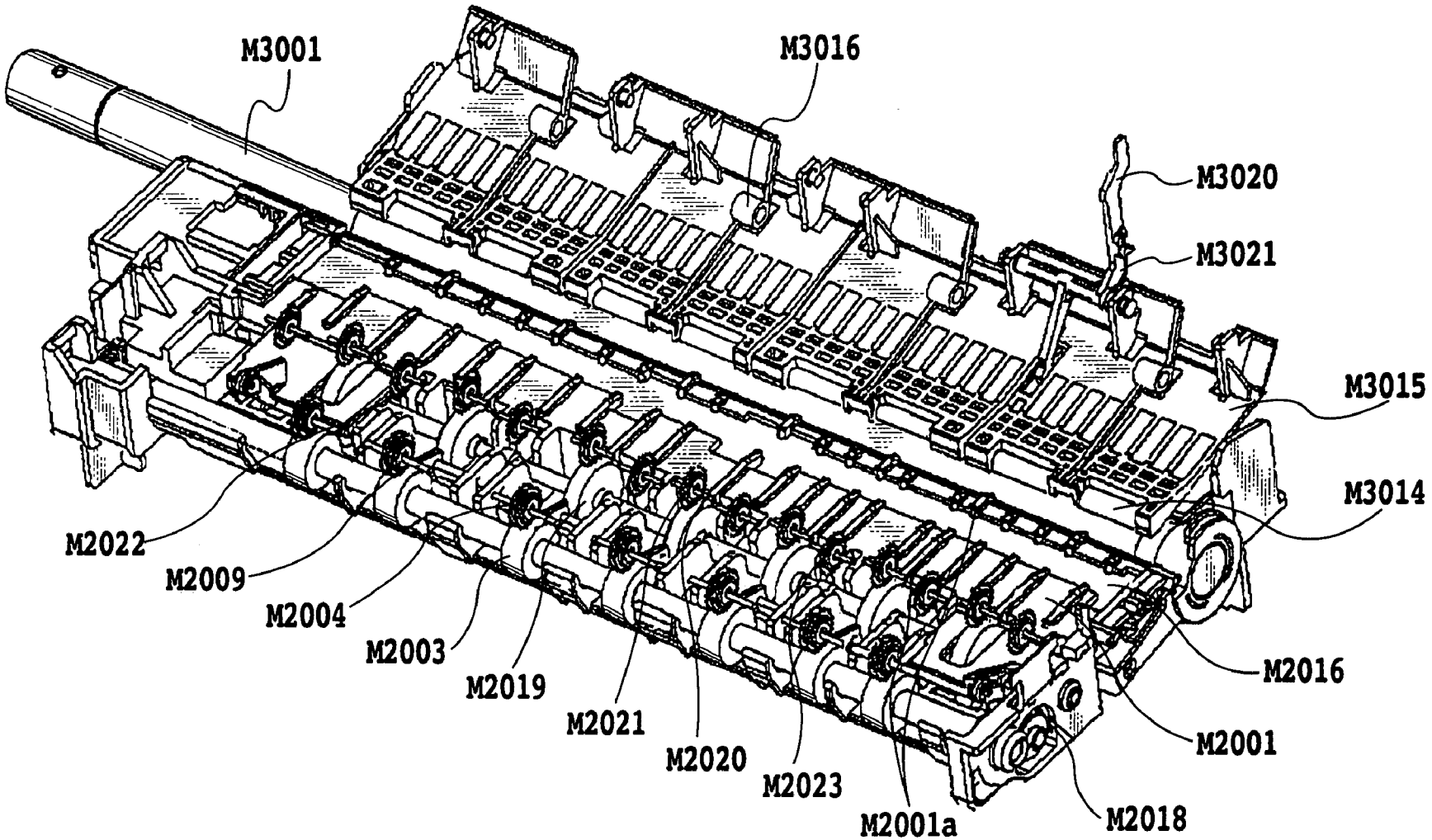
FIG. 4 is a perspective view of the inkjet printing apparatus as is shown in FIG. 3 but not showing some of the internal components thereof.

FIG. 4 is a perspective view partially showing the internal construction of the inkjet printer, as shown in FIG. 3, with the printing head cartridge H1000 dismounted.

The paper discharging portion M3030 comprises a first discharging roller M2003, a discharging gear M3013, a discharging transmission gear, an intermediary discharging transmission gear M2018, a spur base M2006, a first spur M2004, a second spur M2021 and a discharged paper tray M1004.

The first discharging roller 2003 is located on the downstream side in the direction of the transfer of the printing sheet P; one end of the first discharging roller is pivotally supported with the platen M2001 while the other end thereof is also pivotally supported with the chassis M3019 through a first discharging roller bearing M2017. The discharging gear M3013 is attached to one end of the first discharging roller M2003 to transmit the drive of the LF motor to the first discharging roller M2003 through the LF intermediate gear M3012. The discharging transmission gear is attached to the other end of the first discharging roller M2003, while the intermediate discharging transmission gear M2018 meshes with the discharging transmission gear. The spur base M2006 is integrally formed with the discharging transmission gear, which meshes with the intermediate discharging transmission gear M2018. The spur base M2006 is mounted with the first spur M2004 and the second spur M2021. The first spur M2004 is pressed against the first discharging roller M2003 by being forced by a spur shaft M2009 fixed to the spur base M2006 to rotate following the rotation of the discharging roller M2003 so that the printing sheet P can be transferred by being pinched between the first spur M2004 and the discharging roller M2003. The second spur M2021 is pressed against the second discharging roller M2019 by the force of a spur spring shaft M2020 fixed to the spur base M2006 to rotate following the rotation of the discharging roller M2019 thereby to transfer the printing sheet P pinched between the second spur M2021 and the discharging roller M2019. The discharged paper tray M1004 assists the discharging of the printing sheet P.

The printing sheet P, having been transferred to the paper discharging portion M3030, is subjected to the transferring force occurring between the first discharging roller M2003 and the first spur M2004 and the transferring force occurring between the second discharging roller M2019 and the second spur M2021. The rotation axis of the second spur M2020 is offset about 2 mm towards the upstream side from the rotation axis of the second discharging roller M2019. Hence, the printing sheet P to be transferred between the second discharging roller M2019 and the second spur M2021 is made to lightly touch the printing sheet supporting face M2001*a* of the platen M2001 without leaving any gap. In consequence, the printing sheet P can be transferred properly and smoothly.

If the transfer speed occurring between the first discharging roller M2003 and the first spur M2004 and the transfer speed occurring between the second discharging roller M2019 and the second spur M2021 are defined to be the first transfer speed respectively, the first transfer speed is substantially equal to the second transfer speed occurring between the LF roller M3001 and the pinch roller M3014. However, in order to prevent the printing sheet P from becoming too loose, the first transfer speed may be set a little higher than the second transfer speed.

The spur base M2006 is provided with the spur M2022. The spur M2022 is located at a little downstream side of the second spur M2021 and the upstream side of the first spur M2004 but is not located opposing to the second discharging roller M2019 in relation with the location of the second spur M2021. The spur M2022 serves to make the surface of the printing sheet P a little wavy to absorb the displacement (cockling) of the printing sheet P toward the printing head side occurring owing to the effect of the printing made thereon. In this way, the printing sheet P is prevented from coming into contact with the printing head H1000.

Following the completion of the printing of the image with the ink onto the printing sheet P and the subsequent release of the rear end of the printing sheet P from between LF roller M3001 and the pinch roller M3014, the printing sheet P is transferred only between the first discharging roller M2003 and the first spur M2004 and between the second discharging roller M2019 and the second spur M2021 to complete the discharging of the printing sheet P.

(1-2d) Printing Portion

The printing portion M4000 comprises the carriage M4001, movably supported with the carriage shaft M4001, and the printing head cartridge H1000, detachably mounted with the carriage M4001.

The printing head cartridge H1000, as shown in FIG. 3, comprises the ink tank H1900 for storing the ink and the printing head H1001 provided with the nozzles for ejecting the ink supplied from the ink tank H1900 according to the printing information. The printing head H1001 is detachably mounted with the carriage M4001 described later to form a so-called cartridge type construction.

The cartridge H1000 shown in FIG. 3 is capable of printing the photorealistic (photograph-level) high-quality color image. For instance, the ink tank H1900 comprises the independent tanks containing the inks of different colors such as the black, light cyan, light magenta, cyan, magenta and yellow colors respectively, and each of these ink tanks are detachably mounted with the printing head H1001.

The carriage M4001, as shown in FIG. 3, comprises a carriage cover M4002 and a head set lever M4007. The carriage cover M4002 engages with the carriage M4001 to guide the printing head H1001 to the position where the carriage M4001 is to be mounted. The headset lever M4007 compressively engages with the upper part of the printing head H1001 to set the printing head H1001 to a predetermined position.

Further, in the carriage M4001, another engaging part to engage with the printing head H1001 is provided with a contact flexible print cable (contact FPC). When a contact portion E0011*a*, provided with the contact FPC, and a contact portion (an external signal input terminal) not shown, provided with the printing head H1001, are electrically connected with each other, the power to be used for the input and output of various kinds of information to be used for printing and the power to be supplied to the printing head H1001 are made available. A carriage substrate (CRPCB) E0013 mounted on the back of the carriage M4001 is electrically connected with a main substrate E0014, mounted with the chassis M3019, through a carriage flexible flat cable (carriage FFC) E0012. The other end of the carriage FFC E0012 is fixed to the chassis M3019 by means of an FFC holder M4028 and is lead to the back side of the chassis M3019 through an opening (not shown) to be connected with the main substrate.

The carriage substrate is provided with an encoder sensor, and an encoder scale E0005 is extended in parallel with the carriage shaft M4021 and between the two sides of the chassis M3019. The encoder sensor reads the information from the encoder scale E0005 to find the location and the scanning rate of the carriage M4001. In the case of the present embodiment, an optical transmission type sensor is employed as the encoder sensor, while the encoder scale E0005 is one wherein light-intercepting parts for intercepting the detected light coming from the encoder sensor and light-transmitting parts for permitting the transmission of the detected light are printed alternately on a film, formed from a resin material such as polyester, at a predetermined pitch by employing the photoengraving process or the like.

The position of the carriage M4001 traveling along the carriage shaft M4012 is detected by using a reference position where one of the ends of the chassis M3019 located at the ends of the traveling path of the carriage M4001 comes to abut the carriage M4001. In other words, the patterns formed with the encoder scale E0005 are detected sequentially by the encoder sensor as the carriage M4001 travels from the reference position or the abutting position. Then, by counting the number of the detected patterns, the position of the moving carriage M4001 is detected whenever necessary.

The carriage M4001 is guided along the carriage shaft M4012 and a carriage rail M4013 mounted between the two sides of the chassis M3019 to carry out the scanning operation. A bearing portion of the carriage shaft M4012 is integrally formed with a pair of carriage bearings M4029 made from the sintered metal impregnated with the lubricating agent such as the lubricating oil by the process such as the insertion molding process.

Further, the carriage M4001 is connected with a carriage belt M4018. The carriage belt M4018 is extended substantially in parallel with the carriage shaft between an idler pulley M4020 and a carriage motor pulley (not shown). The carriage motor is driven to rotate the carriage motor pulley, thereby causing the carriage belt M4018 to travel either forward direction or backward direction to cause the carriage M4001 to travel along the carriage shaft M4012 for scanning operation.

The carriage motor pulley is held at the predetermined position by the chassis. On the other hand, the idler pulley M4020 is held together with a pulley holder M4021 so as to be movable relative to the chassis M3019, and is forced by a spring in the direction parting from the carriage motor pulley. Thus, a proper tension is always applied to the carriage belt M4018 extended between the two pulleys thereby always maintaining a desirable tension without undesired looseness.

An ink end sensor E0006 is provided on the scanning path of the carriage M4001 on the spur base M2006. The ink end sensor E0006 is designed for detecting the amount of the ink remaining in the ink tank H1900 of the printing head cartridge H1000 mounted with the carriage M4001 and is exposed opposing to the ink tank H1900. The ink end sensor E0006 is contained in an ink end sensor cover M4027, provided with a metal plate for avoiding erroneous operation, whereby the external noise can be intercepted.

(1-2e) Recovery Portion

The recovery portion M5000 is designed to execute the recovery process for the printing head cartridge H1000 and is composed of a recovery system unit detachably provided with the body M1000 of the printing apparatus M1000. The recovery system unit comprises a cleaning means for removing the foreign matters deposited on the printing element substrate of the printing head H1001 and a recovering means for normalizing the condition of the ink flow channel leading to the printing element substrate of the printing head H1001 from the ink tank H1900.

(1-3) Electrical Circuit

Figure 5:
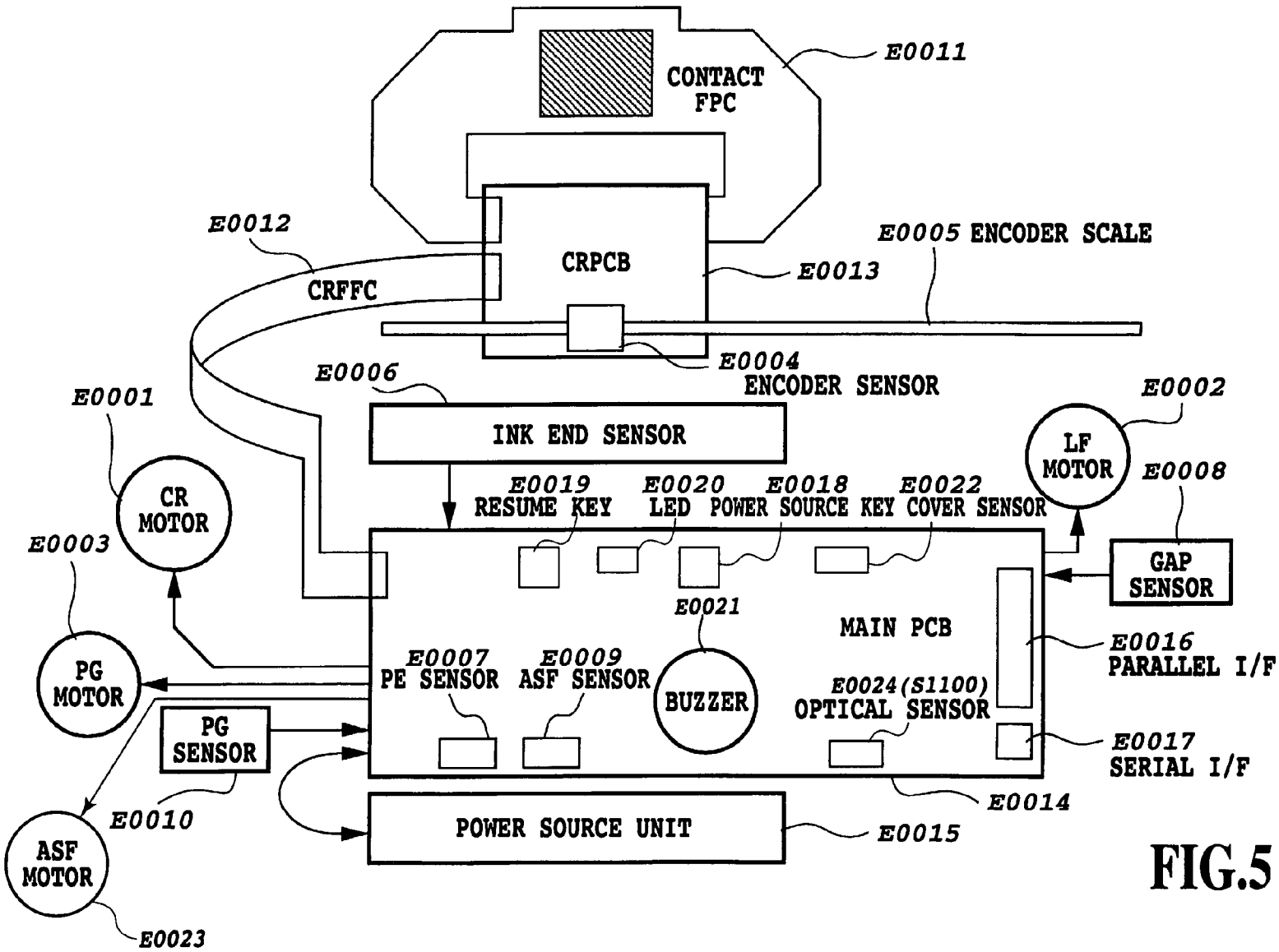
FIG. 5 is a block diagram schematically showing the general composition of the electrical circuit of the inkjet printing apparatus according to the first embodiment of the present invention.

Next, the composition of an electrical circuit in the above-mentioned inkjet printer will be described. FIG. 5 is a block diagram schematically showing the total composition of the electrical circuit of the above-mentioned inkjet printer.

The electrical circuit mainly comprises the carriage substrate (CRPCB) E0013, the main printing circuit substrate (PCB: Printed Circuit Board) E0014, a power source unit E0015 and others.

The power source unit E0015 is connected with the main PCB E0014 to supply the driving power to various parts. The carriage substrate E0013 is a printed circuit substrate unit mounted with the carriage M4001 and functions as an interface for the input and output of the signals with the printing head H1001. Further, the carriage substrate E0013 detects the change in the positional relationship between the encoder scale E0005 and the encoder sensor E0004 on the basis of the pulse signal outputted from the encoder sensor E0004 responding to the travel of the carriage M4001 and outputs the detected signal to the main printed circuit substrate E0014 through the flexible flat cable (CRFFC) E0012.

The main printed circuit board E0014 is a printed circuit board unit for controlling the drive of the various parts of the above-mentioned inkjet printer. The main printed circuit board E0014 comprises I/O ports for the paper end sensor (PE sensor) E0007, an ASF sensor E0009, a cover sensor E0022, a parallel interface (parallel I/F) E0016, a serial interface (serial I/F) E0017, the resume key E0019, the LED E0020, the power source key E0018 and a buzzer E0021 or the like. Further, the main printed circuit board E0014 is connected with a CR motor E0001, an LF motor E0002, a PG motor E0003 and an ASF motor E0023 to control the drive of these motors. Further, the main printed circuit board E0014 is provided with the interface for the connections with an ink end sensor E0006, a GAP sensor E0008, a PG sensor E0010, an optical sensor E0024 for the dot alignment process, the CRFFC E0012 and the power source unit E0015.

Figures 6, 6A:
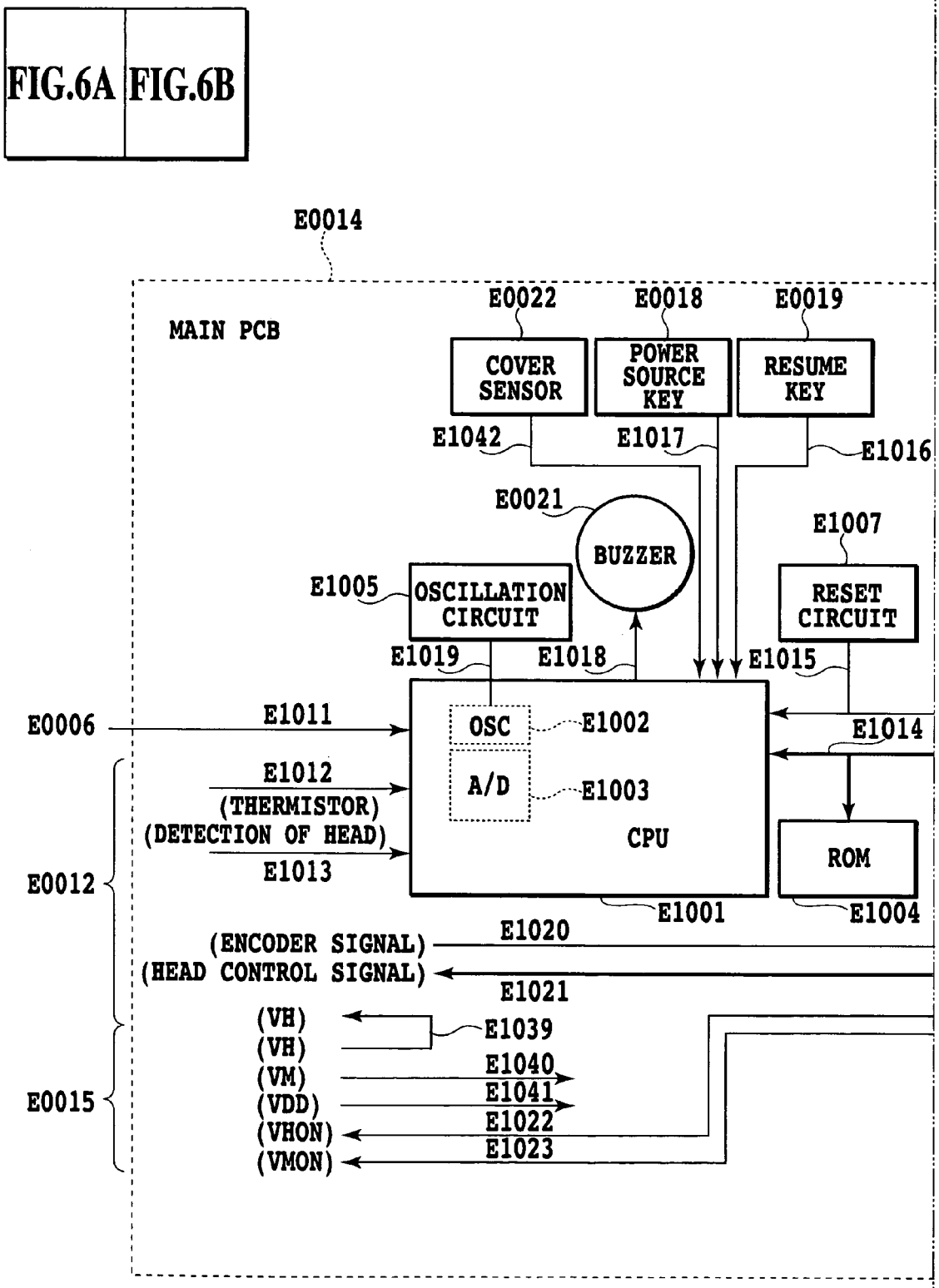
FIG. 6 is a diagram showing the relationship of FIGS. 6A and 6B.
FIG. 6A is a block diagram showing the internal composition of the main PCB as is shown in FIG. 5.
Figure 6B:
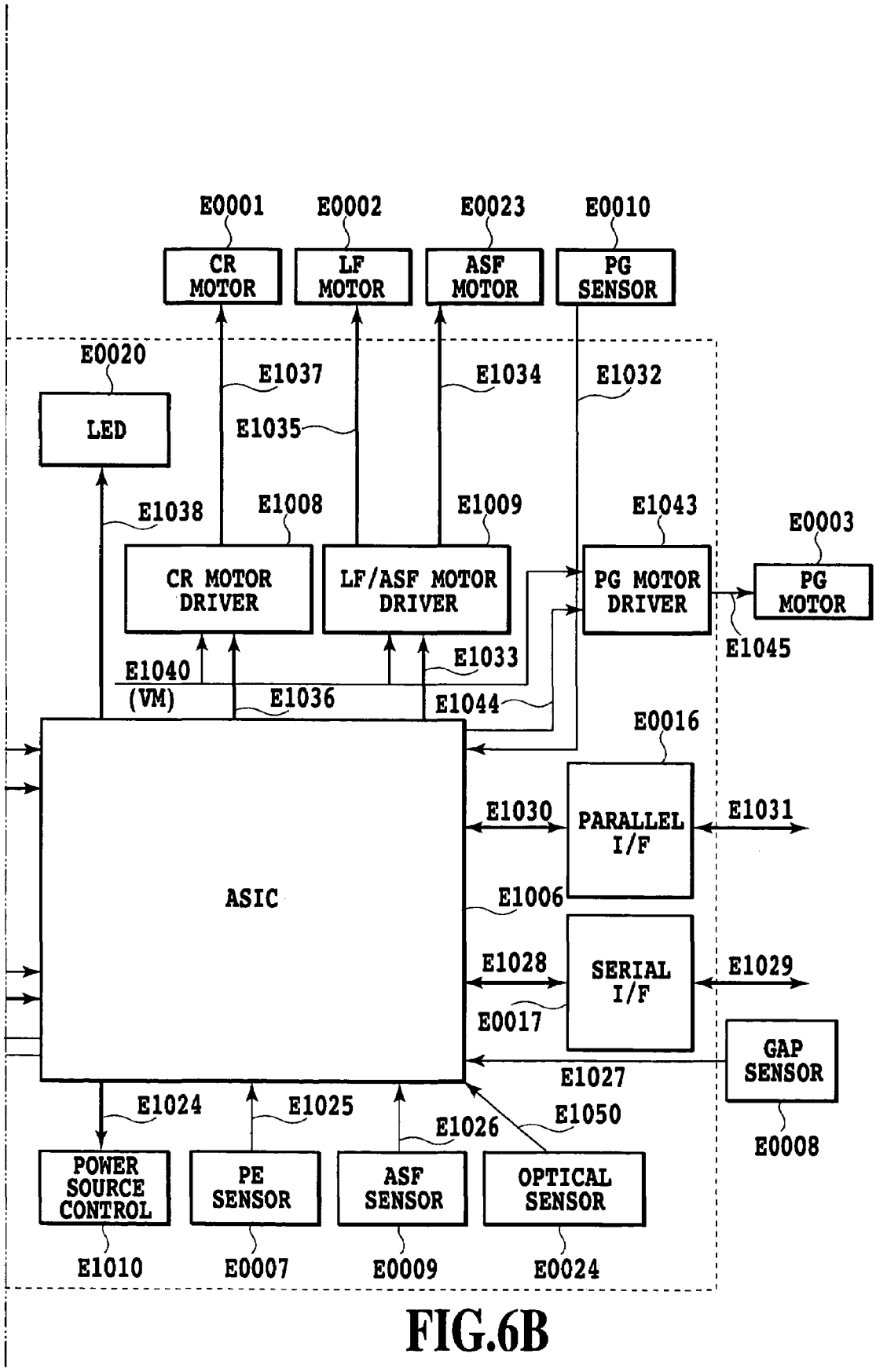
FIG. 6B is a block diagram showing the internal composition of the main PCB as is shown in FIG. 5.

FIG. 6 is a block diagram showing the internal composition of the main PCB. In FIG. 6, reference numeral E1001 denotes the CPU. The CPU E1001 comprises an internal oscillator (OSC) E1002 and is also connected with an oscillation circuit E1005 to generate the system clock on the basis of an output signal E1019 thereof. The CPU E1001 is connected with a ROM E1004 and an ASIC (Application Specific Integrated Circuit) E1006 through a control bus E1014. Further, the CPU E1001 controls the ASIC E1006 according to a program stored in the ROM and also detects the states of an input signal E1017 from the power source key E0018, an input signal E1016 from the resume key, a cover detection signal E1042 and a head detection signal (HSENS) E1013. Further, a buzzer signal (BUZ) E1018 drives the buzzer E0021. Further, the CPU E1001 detects the states of an ink end detection signal (INKS) E1011, to be inputted to an internal A/D converter E1003, and a thermistor temperature detection signal (TH) E1012, performs various arithmetic operations and determines various conditions. In this way, the CPU E1001 controls the operation of the inkjet printer.

The head detection signal E1013 is a signal for detecting that the printing head is mounted and is to be inputted from the printing head cartridge H1000 through the CRFFC E0012, the carriage substrate E0013 and the contact FPC E0011. Further, the ink end detection signal E1011 is an analog signal to be outputted from the ink end sensor E0006, while the thermistor temperature detection signal E1012 is an analog signal outputted from the thermistor (not shown) mounted on the carriage substrate E0013.

Reference numeral E1008 denotes a CR motor driver, incorporating a driving power source, i.e., a motor's power source (VM) E1040, and generates a CR motor drive signal E1037, on the basis of a CR motor control signal E1036 from the ASIC E1006, to drive the CR motor E0001.

Reference numeral E1009 denotes a LF/ASF motor driver, incorporating a power source E1040 for the motor, and is provided for generating a LF motor drive signal E1035 on the basis of a pulse motor control signal (PM control signal) E1033 from the ASIC E1006 to drive the LF motor E0002. Further, the LF/ASF motor driver E1009 generates an AFS motor drive signal E1034 for driving the ASF motor E0023.

Reference numeral E1043 denotes a PG motor driver, incorporating a power source E1040 for the motor, and generates a PG motor drive signal E1045 on the basis of a pulse motor control signal (PM control signal) E1044 to drives the PG motor E0003.

Reference numeral E1010 denotes a power source control circuit for controlling the supply of the power to various sensors provided with the light emitting elements according to a power source control signal E1024 outputted from the ASIC E1006. The parallel I/F E0016 transmits a parallel I/F signal E1030 to a parallel I/F cable E1031 to be connected with external system and also transmits the signal from the parallel I/F cable E1031 to the ASIC E1006. The serial I/F E0017 transmits a serial I/F signal E1028 from the ASIC E1006 to a serial I/F cable E1029 to be connected with the external system and also transmits the signal from the cable E1029 to the ASIC E1006.

The power source unit E0015 provides a printing head power source (VH) E1039, the motor power source (VM) E1040 and a logic power source (VDD) E1041. The ASIC E1006 inputs a printing head ON signal (VHON) E1022 and a motor power source ON signal (VMON) E1023 to the power source unit E0015, whereby the ON/OFF operation of the printing head power source E1039 and the motor power source E1040 are controlled. The voltage of the logic power source (VDD) E1041 supplied from the power source unit E0015 is varied when necessary and is supplied to various internal and external parts of the main PCB E0014. The power from the printing head power source E1039 is smoothed by the main PCB E0014 and supplied to the CRFFCE E0021 to drive the printing head cartridge H1000.

Reference numeral E1007 denotes a reset circuit designed for detecting the drop of logic power source voltage E1040 and supplying a reset signal (RESET) E1015 to the CPU E1001 and ASIC E1006 for initialization.

The ASIC E1006 is a single-chip semiconductor integrated circuit controlled by the CPU E1001 through the control bus E1014. The ASIC E1006 outputs the previously mentioned CR motor control signal E1036, PM control signal E1033, power source control signal E1024, printing head power ON signal E1022, monitor power source ON signal E1024 or the like. Further, the ASIC E1006 makes the transmission and reception of the signals with the parallel I/F E0016 and the serial I/F E0017. Furthermore, the ASIC E1006 detects the states of the a detection signal (PES) E1025 outputted from the PE sensor E0007, an ASF detection signal (ASFS) E1026 outputted from the ASF sensor E0009, a GAP detection signal (GAPS) E1027 outputted from the GAP sensor E0008, a PG detection signal (PGS) E1032 outputted from PG sensor E0010, and an adjustment pattern detection signal E1050, for the detection of the adjustment pattern, outputted from the optical sensor E0024. Then, the ASIC E1006 transmits the data representing the states of the above-mentioned signals to the CPU E1001 through the control bus E1014, and generates a LED drive signal E1038 on the basis of the inputted data to control the ON-OFF operation of the LED E0020.

Further, the ASIC E1006 detects the state of an encoder signal (ENC) E1020 to generate a timing signal and controls the printing operation through the interface with printing head cartridge H1000 by a printing head control signal E1021. The encoder signal (ENC) E1020 is the output signal of the CR encoder sensor E0004 to be inputted through the CRFFC E0012. The printing head control signal E1021 is supplied to the printing head H1001 through the CRFFC E0012, the carriage substrate E0013 and the contact FPC E0011.

Figures 7, 7A:
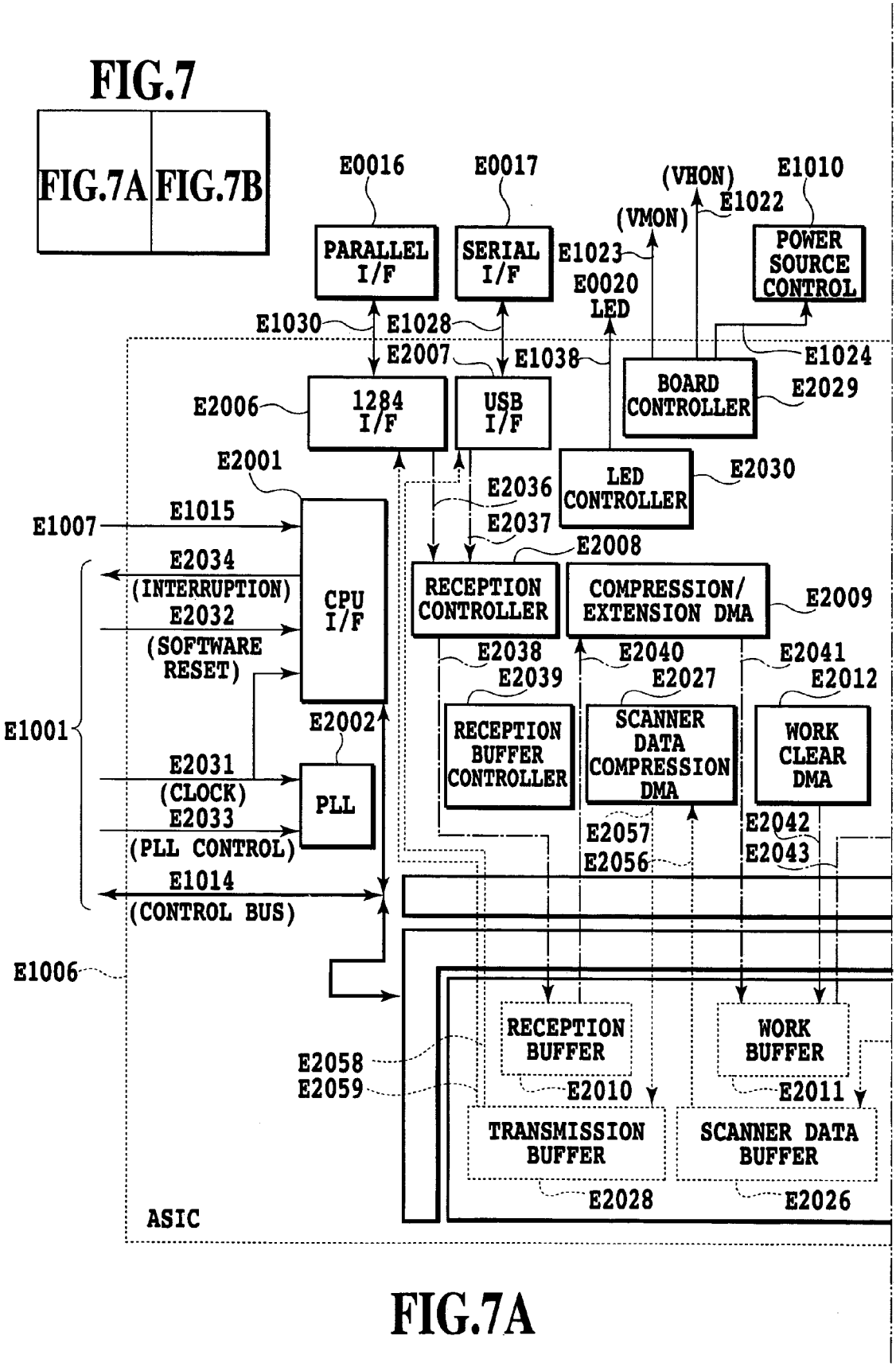
FIG. 7 is a diagram showing the relationship of FIGS. 7A and 7B.
FIG. 7A is a block diagram showing the internal composition of the ASIC as is shown in FIG. 6.
Figure 7B:
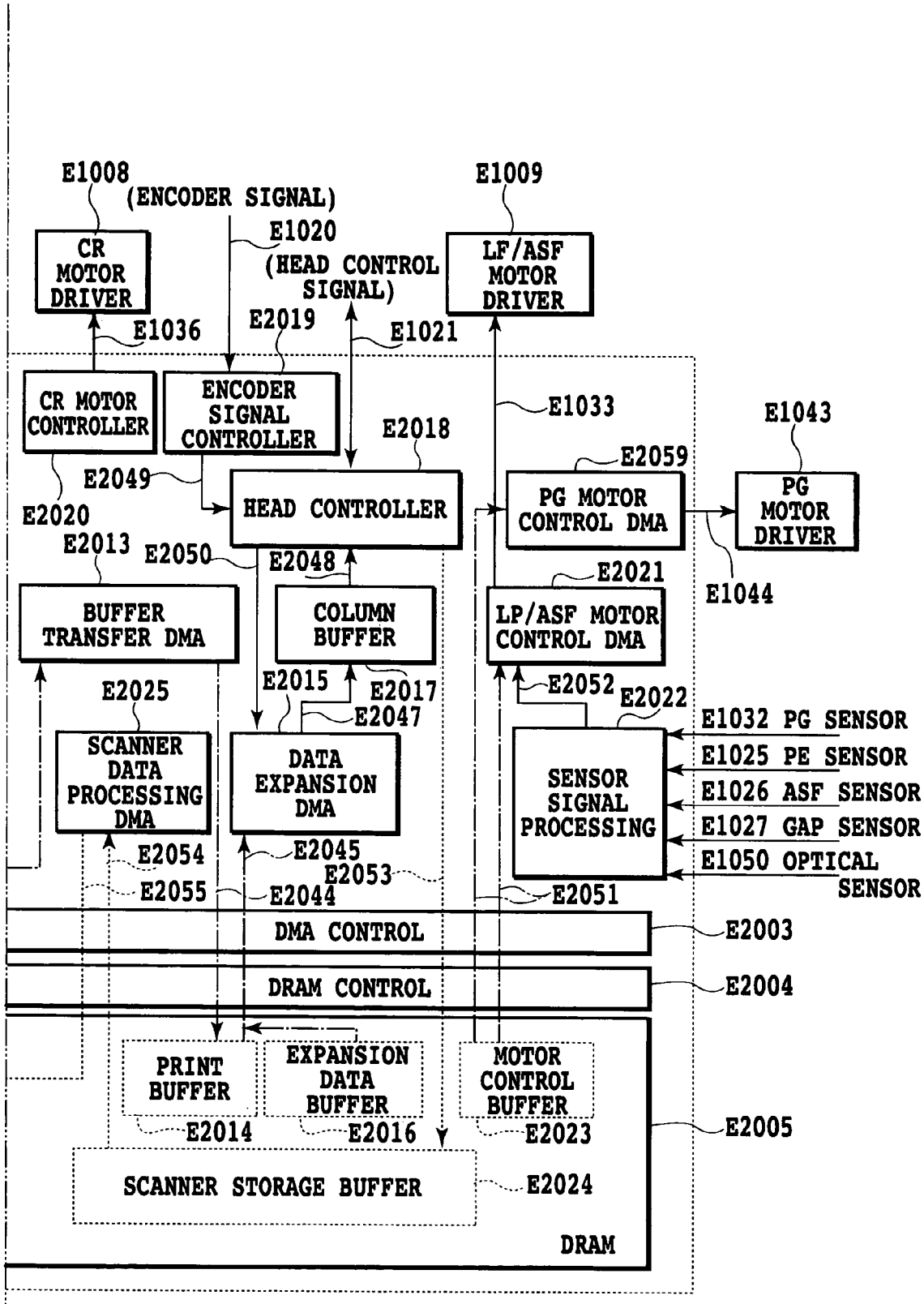
FIG. 7B is a block diagram showing the internal composition of the ASIC as is shown in FIG. 6.

FIG. 7 is a block diagram illustrating the internal composition of the ASIC E1006. In this figure, concerning the connections among various blocks, only the flows of the data such as the printing data and the motor control data relating to the control of the printing head and other various parts are shown. Those control signals relating to the input to and output from the registers incorporated into various blocks and the control signals relating to the DMA control and the like are omitted in the diagram for avoiding the complication of the diagram.

In FIG. 7, reference numeral E2002 denotes a PLL that generates a clock (not shown) to be supplied to the most part of the ASIC E1006 on the basis of a clock signal (CLK) E2031 and a PLL control signal (PLLON) E2033 outputted from the CPU E1001 shown in FIG. 6.

Reference numeral E2001 denotes a CPU interface (CPUI/F) for inputting the reset signal E1015, a software reset signal (PDWN) E2032 outputted from the CPU E1001, the clock signal (CLK) E2031 and the control signal coming from the control bus E1014. As described in the following, the CPU interface E2001 operates, on the bases of such input signals, for the control of the reading and writing with the register of each block, the supply of the clock to some of the blocks, reception of the interruption signal or the like (all not shown) Then, the CPU interface E2001 outputs an interruption signal (INT) E2034 to CPU E1001 to tell the occurrence of the interruption in the ASIC E1006.

Reference numeral E2005 denotes a DRAM designed to function as a printing data buffer comprising various buffers such as a reception buffer E2010, a work buffer E2011, a print buffer E2014, an extension data buffer E2016 and a motor control buffer E2023.

The DRAM E2005 serves as a working area necessary for the operation of the CPU E1001. More specifically, a DRAM controller E2004 is designed for enabling the switching between the access from the CPU E1001 to the DRAM E2005 through a control bus and the access from a DMA controller E2003, which will be described later, to the DRAM E2005 for permitting the reading from and the writing in the DRAM E2005.

The DMA controller E2003 receives the requests (not shown) from various blocks; in the case of an address signal or an control signal (not shown) and in the case of a writing operation, the data to be written (E2038, E2041, E2044, E2053, E2055, E2057 or the like) are outputted to RAM controller to make the access to the DRAM. Further, in the case of the read-out operation, the data (E2040, E2043, E2045, E2051, E2054, E2058 and E2059) read out from the DRAM controller E2004 are outputted to the block as being the source of the request.

Reference numeral E2006 denotes a 1284 I/F, that is, an interface for the 2-way communication with the external host system (not shown) through the parallel I/F E0016 under the control of the CPU E1001 through the CPU I/F E2001. Further, at the time of printing operation, a data (a PIF receiving data E2036) received through the parallel I/F E0016 is outputted to a reception controller E2008 after being processed by DMA process.

Reference numeral E2007 denotes a USB I/F to serve as an interface for the 2-way communication with external host system (not shown) through the serial I/F E0017 under the control of the CPU E1001 through the CPU I/F E2001. Further, for the printing operation, the data (a USB receiving data E2037) received through the serial I/F E0017 is outputted to the reception controller E2008 after being processed by DMA process. The reception controller E2008 writes the data (WDIF) E2038, received through any one selected from 1284 I/F E2006 and USB I/F E2007, in a writing address of a reception buffer controlled by a reception buffer controller E2039.

Reference numeral E2009 denotes a compressible/expansible DMA designed for reading a received data (raster data) stored with a reception buffer E2010 through a reading address of the reception buffer, controlled by the reception buffer controller E2039, through the CPU I/F E2001 under the control of the CPU E1001. Then, the read-out data (RDWK) E2040 is compressed or expanded according to a specified mode and written in a work buffer area in the form of a printing code column (WDWK) E2041.

Reference numeral E2013 denotes a buffer data transfer DMA to be used for reading a printing code (RDWP) E2043 from a work buffer E2011 through the CPU I/F E2001 under the control of the CPU E1001. Then, the buffer data transfer DMA E2013 rearrange the printing codes into the addresses matching with the addresses in a print buffer E2014 and suiting the data transmission sequence to the printing head cartridge H1000 prior to the transmission (WDWP E2044).

Reference numeral E2012 denotes a work clear DMA and serves in repetitively writing a specified work fill data (WDWF) in the area of the work buffer, whereto the transfer of the data by a printing buffer transfer DMA E2013 is completed, through the CPU I/F E2001 under the control of the CPU E1061.

Reference numeral E2015 denotes a printing data expansion DMA designed for reading the printing codes written in the printing buffer after being rearranged and the data for expansion written in the expansion data buffer E2016 through the CPU I/F E2001 controlled by the CPU E1001 by using a data expansion timing signal E2050 coming from a head controller E2018 as the trigger. Then, the printing data expansion DMA generates an expansion printing data (RDHDG) E2045 to be written in a column buffer E2017 as a column buffer writing data (WDHDG) E2047.

The column buffer E2017 is a SRAM for temporarily storing the data to be transmitted (expansion printing data) to the printing head cartridge H1000. The column buffer E2017 is controlled commonly by the printing data expansion DMA and the head controller (i.e., by these 2 blocks) by means of the handshaking signal (not shown).

The head controller E2018 serves as an interface to the printing head cartridge H1000 by using the head control signal and through the CPU I/F E2001 under the control of the CPU E1001. Further, a data expansion timing signal E2050 is outputted to the printing data expansion DMA on the basis of a head drive timing signal E2049 coming from an encoder signal controller E2019.

Further, in carrying out the printing operation, the head controller E2018 reads an expansion printing data (RDHD) E2048 from the column buffer according to the head drive timing signal E2049 and outputs the read-out data, as the head control signal E1021, to the printing head cartridge H1000.

Responding to the encoder signal (ENC), the encoder signal controller E2019 outputs the head drive timing signal E2049 according to the mode specified under the control of the CPU E1001. Further, the information concerning the speed and the position of the carriage M4001 obtainable from the encoder signal E1020 is stored with the register for output to the CPU E1001. On the basis of the information, the CPU E1001 determines various parameters applicable to the control of CR motor E0001.

Reference numeral E2020 denotes a CR motor controller for outputting a CR motor control signal E1036 to a CR motor driver through the CPU I/F E2001 under the control of the CPU E1001.

Reference numeral E2022 denotes a sensor signal processor for receiving the detection signals outputted from PG sensor E0010, PE sensor E0007, ASF sensor E0009 and GAP sensor E0008 (signals denoted by E1032, E1025, E1026 and E1027 respectively). Then, various kinds of information obtained from these sensors are transmitted to the CPU E1001 according to the specified modes. Further, a sensor detecting signal E2052 is outputted to a LF/ASF motor control DMA E2021.

The LF/ASF motor control DMA E2021 and PG motor control DMA E2059 read a pulse motor drive table (RDPM) E2051 from a motor control buffer E2023 in the DRAM E2005, through the CPU I/F E2001 under the control of the CPU E1001, and output the pulse motor control signals E1033 and E1044. Further, depending on the operation mode, the pulse motor control signals E1033 and E1044 are outputted with the detection signal of the sensor serving as the triggers.

Reference numeral E2030 denotes an LED controller to output an LED drive signal E1038 through CPU I/F E2001 under the control of the CPU E1001. Reference numeral E2029 denotes a port controller to output the printing head power source ON signal E1022, the motor power source ON signal E1023 and the power source control signal E1024 through the CPU I/F E2001 under the control of the CPU E1001.

(1-4) Optical Sensor

Figure 8:
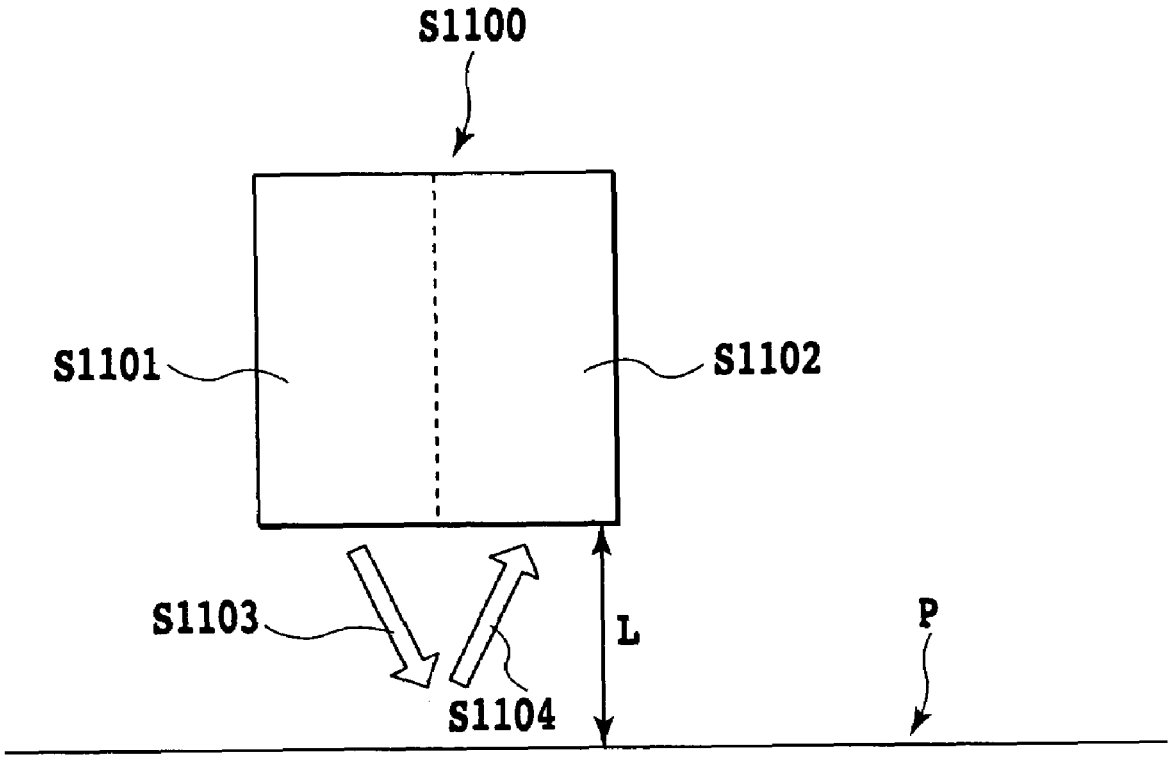
FIG. 8 is a diagram schematically illustrating the function of the optical sensor provided with the inkjet printing apparatus as is shown in FIG. 2.

FIG. 8 is a diagram schematically illustrating the reflection optical sensor S1100 used in the printer (printing apparatus) shown in FIG. 2.

The reflection optical sensor S1100 (E0024) is used in detecting the printing position detection adjustment pattern printed on the printing medium. As mentioned previously, this reflection optical sensor S1100 is mounted with the carriage M4001 and comprises a light emitter S1101 and a photodetector S1102. The light (I in) S1103 emitted from the light emitter S1101 is reflected by the printing sheet P, as being a printing medium, and the reflected light (I ref) S1104 can be detected by the photodetector S1102. The signal detected by the optical sensor S1100 is transmitted to a control circuit formed on the printed circuit board E0014 of the printer (printing apparatus) through the carriage flexible flat cable (carriage FFC) E0012 (FIG. 3) and is converted to a digital signal by means of an A/D converter connected with the control circuit. For the A/D converter the previously described A/D converter E1003 can be used.

The location of the optical sensor S1100 to be mounted with the carriage M4001 should be a location not included in the traveling path of the ink ejecting openings of the printing head H1001 so as to prevent the ink droplets from depositing thereon. In other words, the mounting location of the optical sensor S1100 relative to the carriage M4001 is set avoiding the traveling path of the ink ejecting openings of the printing head H1001 during the scanning for printing operation. The optical sensor S1100 can be of relatively low resolution thereby contributing to the reduction of the manufacturing cost.

In the present embodiment, the optical sensor S1100 may be one designed to be selected an appropriate luminescent color depending on a color tone of the ink used in the printer or the composition of the printing head H1001. For instance, the red LED or the infrared LED may be used so that the dots formed by the inks having a high absorption coefficient to the luminescent colors can be subjected to the previously mentioned dot alignment process. In such a case, however, it is desirable to choose the black (Bk) ink or cyan (C) ink as the subjects of the dot alignment process, since adequate density characteristic or S/N ratio are hard to be obtained from the magenta (M) ink and yellow (Y) ink. Hence, the luminescent color being dependent on the characteristic of the LED can be made to correspond to the color of the ink. For instance, when the blue LED and the green LED are used besides the red LED, the dot alignment process can be applied so as to adjust the forming position for each of the cyan (C) ink dots, the magenta (M) ink dots and the yellow (Y) ink dots relative to the forming positions of the black (Bk) ink dots.

The First Embodiment

Next, the first embodiment of the present invention will be described in the following.

The first embodiment is designed to enable an automatic dot alignment process applicable to the inkjet printing apparatus mounted with the above-mentioned optical sensor S1100. Conventionally, in the case of this kind of printing apparatus, as mentioned previously, there is the possibility that the condition of the printing medium changes when the printing medium position adjustment pattern is printed on the printing medium by using the ink. For instance, when the cockling or the curling has occurred with the printing medium, the accuracy in reading the printing position adjustment pattern by the optical sensor can become poor to become a hindrance to the execution of accurate dot alignment process. Such cockling or curling occurs when the printing medium expands (or extends) slightly owing to the absorption of the water content (of the ink) in the process of the printing of the image on the printing medium. As mentioned previously, the dot alignment process is designed for obtaining the adjusting value to be applied when adjusting the position of the ink dot to be formed on the printing medium (printing position) so that the printing position can be adjusted according to the obtained adjusting value, and, depending on the situation, the dot alignment process may include the process for controlling the printing process while adjusting the printing position according to the determined adjusting value.

In the first embodiment of the present invention, in consideration of the point indicated above, the location of the optical sensor S110 is specified. In other words, in order to avoid the effect of the deformation of the printing sheet P (printing medium) on which the printing position adjustment pattern is printed, that is, in order to avoid the cockling or curling of the printing sheet P, the optical sensor S1100 is located in the vicinity of the pinch rollers M3014 as being a paper hold-down mechanism, as described later.

First, the output characteristic of the optical sensor S1100 will be described.

Figure 9:
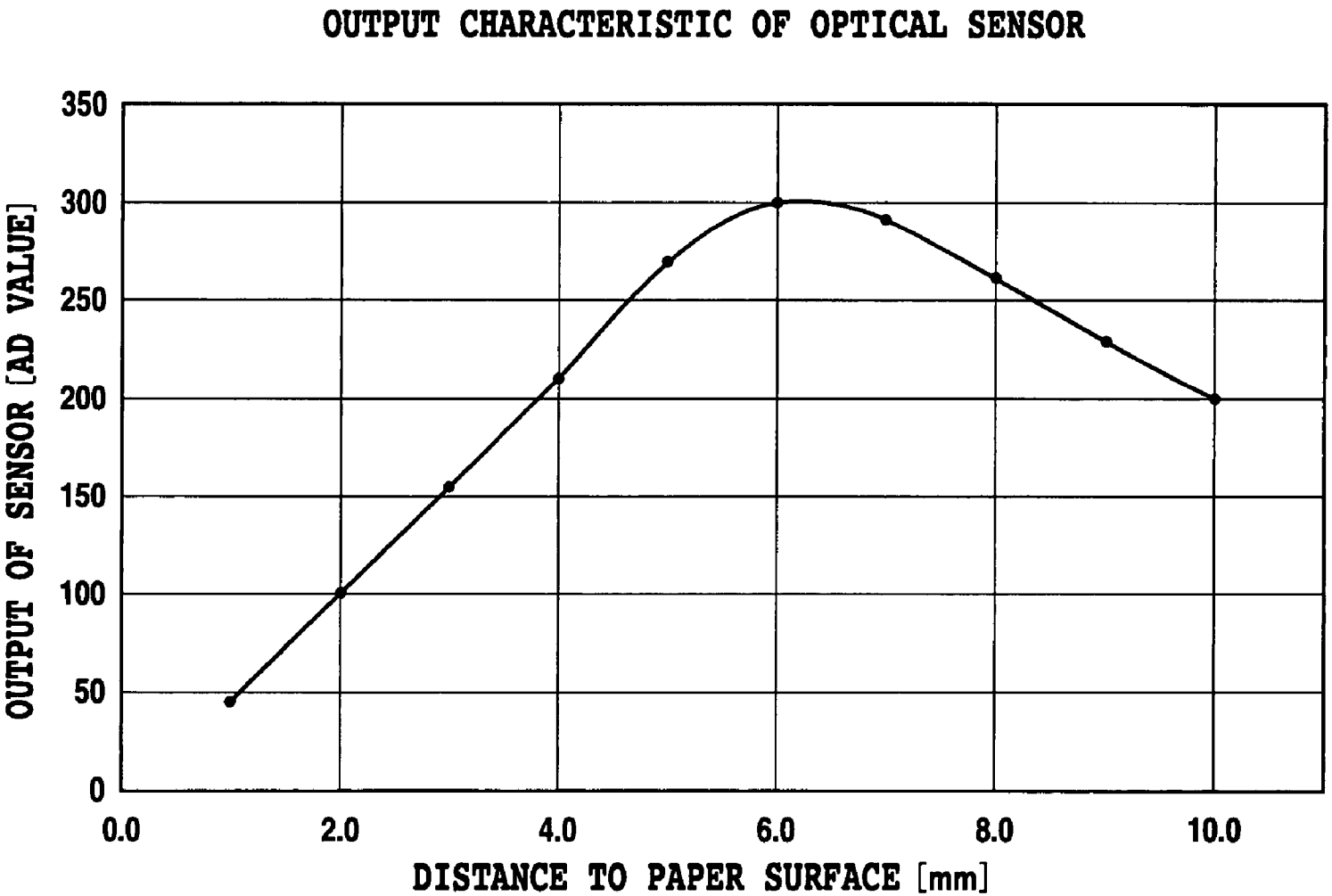
FIG. 9 is a characteristic diagram showing an example of the output characteristic of the optical sensor as is shown in FIG. 8.

FIG. 9 is a diagram illustrating the output characteristic of the reflection optical sensor S1100 as is shown in FIG. 8. The horizontal axis represents the distance L (Refer to FIG. 8) between the optical sensor S1100 and the object; in the present embodiment, the object of the measurement is the printing sheet P, as being the printing medium, and so the distance is described as "the distance to printing sheet". The vertical axis represents the output of the optical sensor as the result of the measurement. The output of the optical sensor S1100 is primarily expressed in analog voltage value in many instances. In the case of the present embodiment, however, the output of the optical sensor S1100 is expressed in AD value converted to the digital data because the data is used in the printer for controlling. Further, the output characteristic of the optical sensor S1100 shown in FIG. 9 represents the result of the measurement of the same object, that is, the output at the time when the distance (distance to the paper sheet) L has varied.

In the case of the output characteristic shown in FIG. 9, the peak is in the vicinity of the position where the distance L (distance to the paper sheet) is 6.0 mm. At the positions where the distance L is smaller than 6.0 mm, the output rises steeply; for instance, AD value varies by about 50 for every distance of 1 mm. On the other hand, at the positions where the distance L is larger than 6 mm, the AD value varies by about 25 for every distance of 1 mm. If it is to be attempted to detect the position adjustment pattern printed on the printing sheet P at higher accuracies by the optical sensor S1100 in order to make the dot alignment with higher accuracy, the variation of the AD value becomes a major factor of error.

Incidentally, in the case of the previously mentioned Japanese Patent Application Laid-open No. 11-291470(1999), the matching of the printing positions (the printing position adjustment) for the printing head of the printing apparatus is made on the basis of the optical characteristic (reflection density) of the optical sensor. Further, for instance, in the case of the adjustment pattern printed on an ordinary paper sheet by using the cyan ink, the read-out output varies at about 100 in terms of the AD value depending on the position of the dot when the adjustment accuracy is set to 600 dpi. Depending on the characteristic of the variation the proper position of the dot is determined. However, with the adjustment accuracy set to 1200 dpi, only the variation at least the level of 50 in terms of the AD value can be expected.

In the case of the output characteristic shown in FIG. 9, the output characteristic of the optical sensor is considerably affected by the variation of the distance (variation of the distance to the paper sheet) within the range where the distance L (distance to paper sheet) is less than 6.0 mm. In applying the high-resolution dot alignment, it is important not only to adopt system wherein the output characteristic in the range where the effect of the variation of the distance L (the distance to the paper sheet) is relatively small but also the variation of the distance L itself can be reduced.

Figure 10:
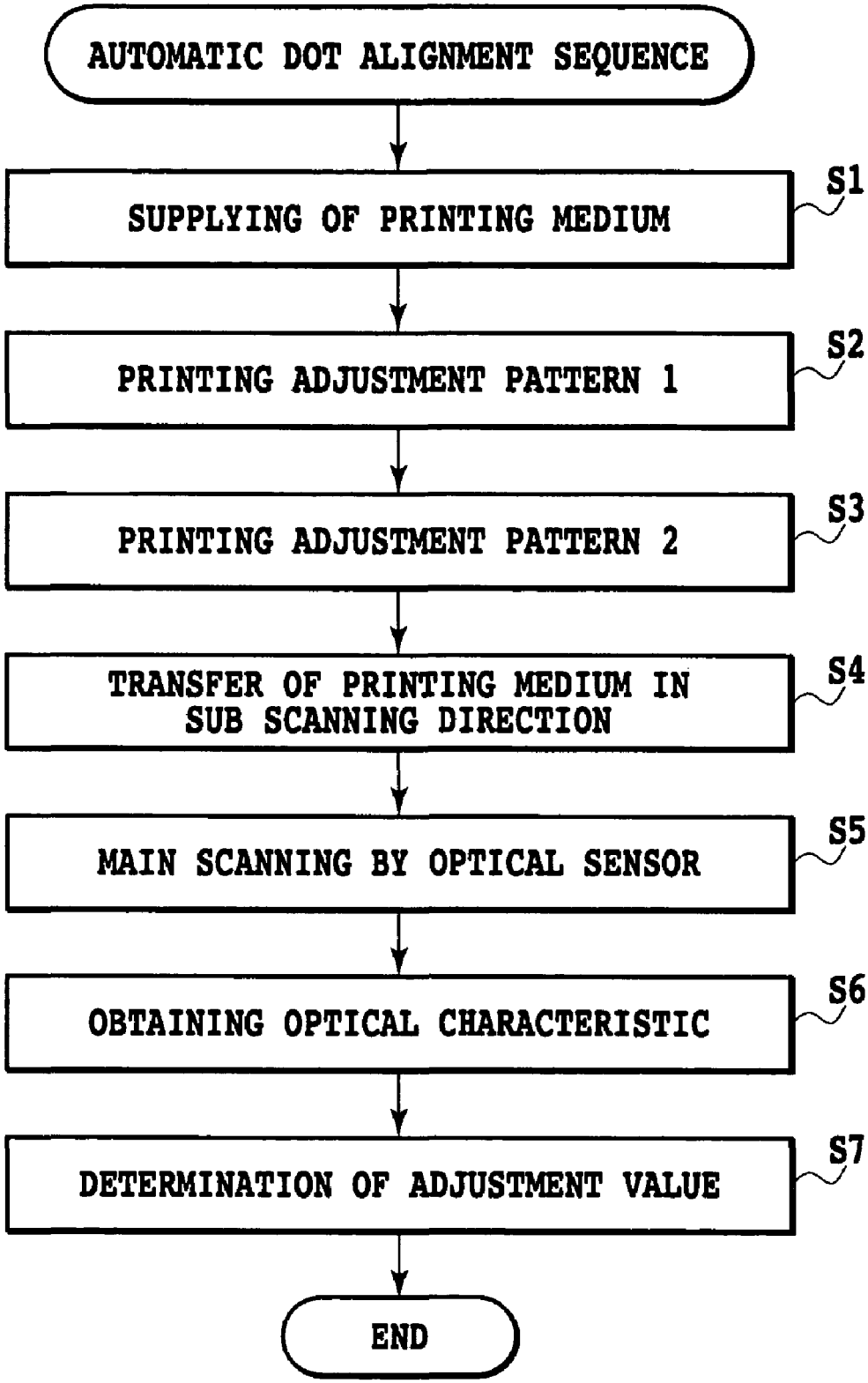
FIG. 10 is a flow chart illustrating the automatic dot alignment process according to the first embodiment of the present invention.

In consideration of such output characteristic of the optical sensor S1100, in the case of the present embodiment, the automatic dot alignment process is executed according to the flowchart shown in FIG. 10. FIG. 10 shows an example of the automatic dot alignment process. In the case of the present embodiment, the dot alignment process means the process for determining the adjustment value for adjusting the position (printing position) on the printing medium whereon the ink dot is formed and does not include the process for controlling the printing operation on the basis of the determined printing position adjustment value.

In the automatic dot alignment process shown in FIG. 10, the printing medium (a printing sheet P in the case of the present embodiment), for printing the adjustment pattern thereon, is fed first (Step S1). Next, an adjustment pattern 1 is printed on the printing medium (Step S2). Then, an adjustment pattern 2 is printed (Step S3). Here, the adjustment pattern 1 and the adjustment pattern 2 can be, for example, the patterns for matching the printing position (the printing position adjustment) for the forward printing and the backward printing in the 2-way printing operation, or the adjustment patterns for matching the printing position for the printing head for ejecting the black ink with the printing position of the printing head for ejecting the color ink (inks other than the black ink), or the adjustment patters for matching the printing position of the printing head provided with the large nozzle for large dot formation and with the printing position of the printing head provided with the small nozzle for small dot formation. These adjustment patterns 1 and 2 are printed simultaneously at the same scanning operation if these patterns can be printed simultaneously; otherwise, these patterns are printed at the different scanning operation if these patterns can not be printed simultaneously.

Next, the printing medium having the adjustment pattern printed thereon is transferred along the sub-scanning direction, that is, the printing medium is fed along the feeding direction (Step S4). The mounting location of the optical sensor S1100 is set to a predetermined position where the effect of the variation of the distance L (the variation of the distance to the paper sheet) on the output characteristic of the optical sensor can be minimized, that is, the location where the range wherein the variation of the distance L is small can be utilized. In Step S4, the printing medium is moved to the location where the adjustment pattern and the optical sensor S1100 come to oppose to each other so that the printing medium can be placed at the scanning position of the optical sensor S1100. As discussed later, in the case of the present embodiment, owing to the construction of the transfer mechanism of the printing medium, the mounting location of the optical sensor S1100 with the carriage M4001 is set in the vicinity of the pinch roller M3014. Hence, the optical sensor S1100 and the pinch roller M3014 are located on the upstream side of the printing head H1001 in the transfer direction of the printing medium. In consequence, the printing medium whereon the adjustment pattern is printed by the printing head H1001 is transferred in reverse direction (back feeding direction) to the direction of the transfer of the printing medium in Step 4.

Next, the adjustment pattern printed on the printing medium is scanned with the optical sensor S1100 (Step S5). That is, the optical sensor S1100, together with the carriage M4001, is made to travel in the main scanning direction to scan the adjustment pattern. With this scanning operation the optical characteristic of the adjustment pattern is obtained (Step S6). In other words, the optical characteristic of the adjustment pattern is obtained from the output value of the optical sensor S1100 each time when the adjustment pattern is scanned. The output value of the optical sensor S1100 is temporarily stored in the printer, and the optimal dot alignment adjustment value is set on the basis of such result of the output (Step S7). In such a case, the adjustment value can be set based on the result of the simple comparison of the output values of the adjustment patterns 1 and 2 obtained by scanning, and also the optimal adjustment value can be set by an arithmetic calculation. In short, the appropriate adjustment value can be set depending on the required adjustment accuracy of the printing position.

More specifically, where the adjustment patterns 1 and 2 are the patterns designed for the matching of the printing positions of the forward printing and the backward printing in the case of the 2-way printing operation, the adjustment values necessary for fulfilling such requirements can be set. Similarly, when the adjustment patterns 1 and 2 are the patterns designed for the matching of the printing position of the printing head for ejecting the black ink and the printing position of the printing head for ejecting the color ink (ink other than the black ink), the adjustment values necessary for such matching of the printing positions can be set. Further, when the adjustment patterns 1 and 2 are the patterns designed for the matching of the printing positions of the printing head with large-size nozzle for the formation of relatively large dots and the printing head with small-size nozzle for the formation of relatively small dots, the adjustment values necessary for such printing position matching can be set. The set adjustment values are temporarily stored in the printer and also stored in the memory such as the nonvolatile memory when necessary.

Figure 15A:
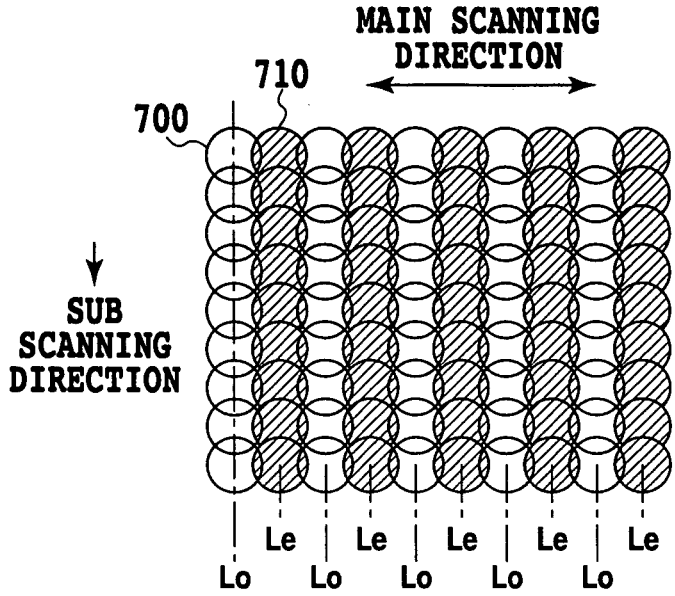
FIGS. 15A, 15B and 15C are diagrams illustrating the examples of the adjustment patterns according to the first embodiment of the present invention.
Figure 15B:
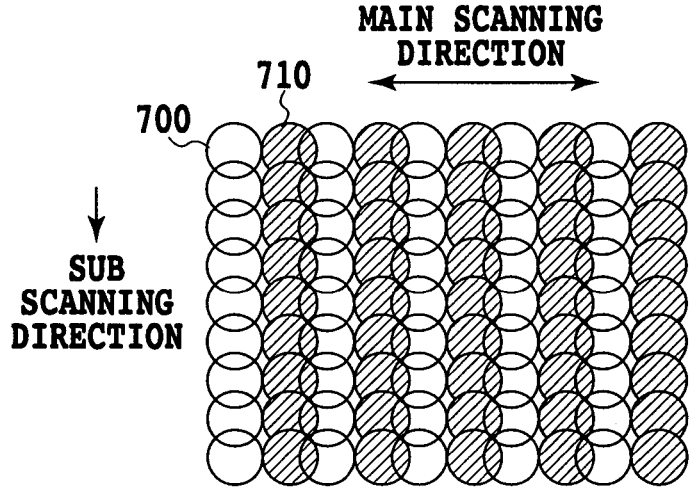
Figure 15C:
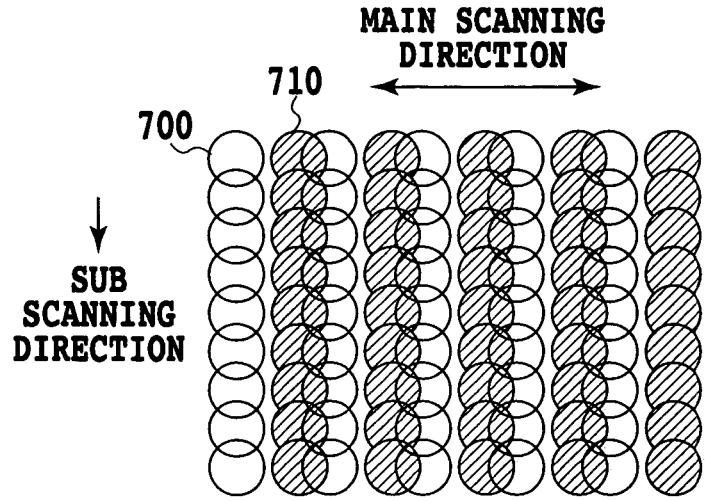

FIG. 15A, FIG. 15B and FIG. 15C are the diagrams illustrating the printing examples of the adjustment patterns for the matching of the printing position in the forward printing process with the printing position in the backward printing process in the case of the 2-way printing operation. In these diagrams, those dots 700 represented by the outline circles constitute the adjustment pattern 1 to be printed during the forward scanning, while those dots 710 represented by the hatched circles constitute the adjustment pattern 2 to be printed during the backward scanning. In the case of the present embodiment, these dots 700 and 710 are formed with the inks ejected from a common printing head, so that whether the dots are represented by outline dots or the hatched dots is nothing but the convenience of the illustration and thus not corresponding to the colors or the densities of the colors of the dots.

FIG. 15A shows the arrangement of the dots wherein the printing position in the forward printing and the printing position in the backward printing match with each other; FIG. 15B shows the arrangement of the dots wherein the printing positions are slightly out of matching; FIG. 15C shows the arrangement of the dots wherein the printing positions are further out of matching. In the case of the present embodiment, the dots are formed supplementarily by means of the back-and-forth scanning. In other words, in the forward printing, dots on lines Lo of the odd-number column are formed, while in the backward printing, dots on lines Le of the even-number column are formed. Hence, as seen from FIG. 15A, the condition, wherein the dots 700 and the dots 710 are deviated from one another by the distance equivalent to the diameter of one dot in the main scanning direction, is the condition wherein the printing positions match with one another.

Further, the adjustment patterns 1 and 2 according to the present embodiment are set so that printing density is reduced as the degree of the disagreement of the printing positions increases. More particularly, in the case of the adjustment pattern shown in FIG. 15A, an area factor in the printing area is about 100%. As seen from FIG. 15B and FIG. 15C, as the degree of deviation from the normal printing position increases, not only the degree of overlapping between the dots 700 and the dots 710 increase but also the areas not covered by either the dots 700 or the dots 710 increase. In consequence, the area factor drops entailing the drop of the general density of the adjustment pattern. The printing densities of such adjustment patterns 1 and 2 are scanned with the optical sensor S1100 to determine the adjustment values for the matching of the printing positions of the forward printing and the backward printing. The similar process applies to the cases where the adjustment patterns 1 and 2 are designed for the matching of the printing position of the printing head for the back ink ejecting with the printing position of the printing head for the color ink (inks other than black ink) ejecting. Further, the similar process also applies to the cases of the adjustment patterns 1 and 2 designed for the matching of the printing position of the printing head with the nozzle for forming relatively large dots and the printing position of the printing head with the nozzle for forming relatively small dots.

Next, the peripheral composition of the printing head according to the present embodiment will be described.

Figure 11:
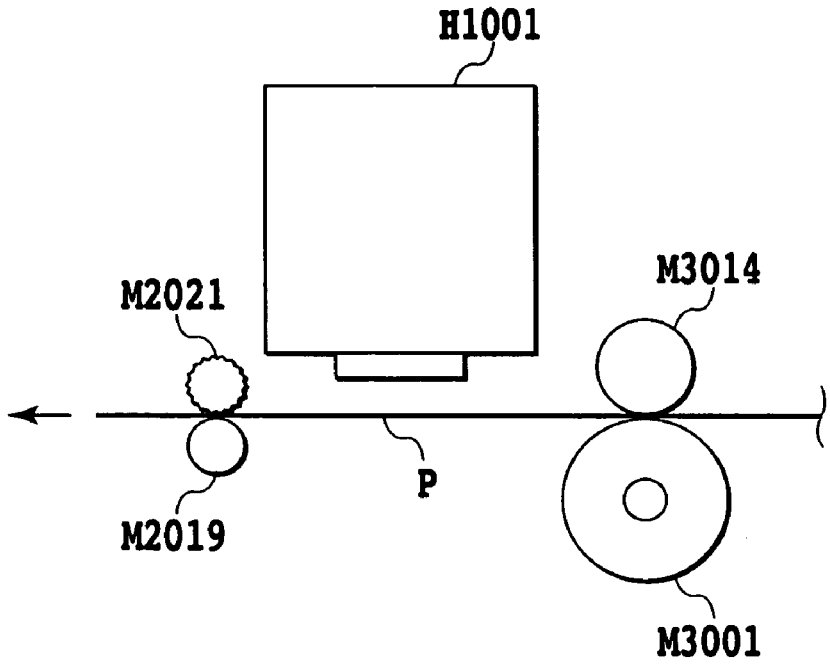
FIG. 11 is a diagram schematically illustrating the positional relationship between the printing medium and the printing head according to the first embodiment of the present invention.

FIG. 11 is diagram illustrating the transfer mechanism for the printing medium located in the vicinity of the printing head H1001. The printing medium (printing sheet P in the case of the present embodiment) is fed from the sheet feeding side on the right-hand side in FIG. 11 to come between the pinch roller M3014 and LF roller (i.e., paper feeding roller) M3001 and is transferred to the printing position of the printing head H1001. The amount of the transfer of the printing medium is controlled by the rotation of the LF roller M3001, while the pinch roller M3014 presses the printing medium against the LF roller M3001 so that the amount of the transfer of the printing medium can be controlled accurately. On the downstream side (on the paper ejection side) of the printing position of the printing head H1001, the printing medium comes between the discharging roller (or paper discharging roller) and the spur (or paper discharging spur) M2021 to be discharged (or paper discharging) towards the left-hand side in FIG. 11. The transfer of the printing medium to be discharged is controlled by the rotation of the discharging roller M2019, while the spur M2021 presses the printing medium against the discharging roller M2019 so that the amount of the transfer for the discharging can be controlled accurately.

Since the spur M2021 is a member coming into contact with the printed printing medium, the pressure thereof to the printing medium cannot be increased freely in consideration of the effect of the pressure on the printed surface of the printing medium. For this reason, the magnitude of the pressure of the pinch roller M3014 is set larger than that of the spur M2021. Further, as shown in FIG. 4, the pinch roller M3014 is designed to apply the pressure thereof to almost overall width of the printing medium, whereas the spur M2021 is designed to apply the pressure thereof only to a limited area of the printing medium. The spur M2021 comes into contact with the printed surface of the printing medium and thus is designed as described previously. For this reason, the pinch roller M3014 is designed so as to be able to apply a larger pressure to the printing medium than the spur M2021. The printing head H1001 is disposed between the LF roller M3001 and the discharging roller M2019; the printing head H1001 ejects the droplets of the ink to form the dots on the surface of the printing medium for making desired printing.

Next, the behavior of the printing medium during the actual printing operation will be described.

Figure 12:
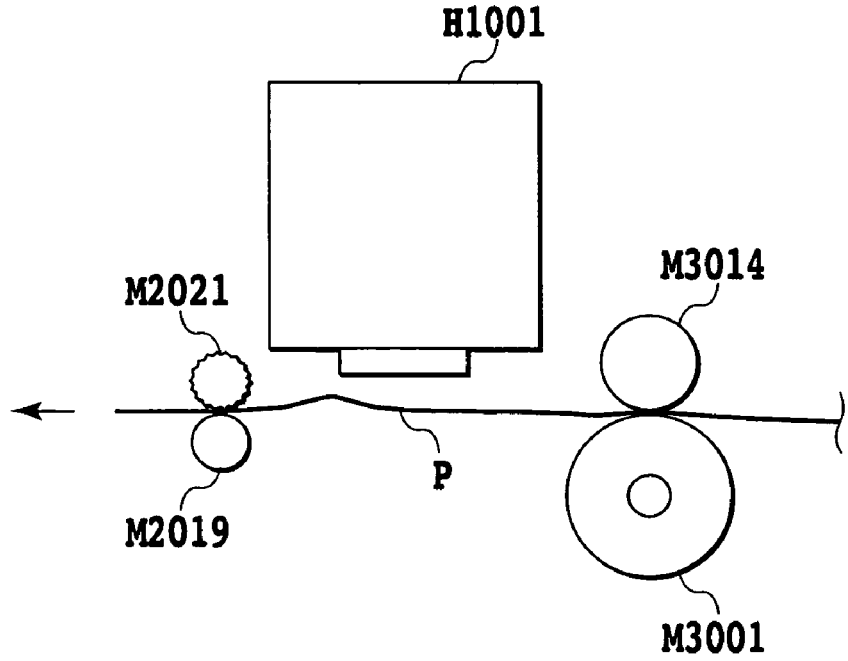
FIG. 12 is a diagram schematically illustrating the positional relationship between the cockled printing medium and the position of the printing head according to the first embodiment of the present invention.

FIG. 12 shows the condition of the printing medium (the printing sheet P in the case of the present embodiment) after having undergone the printing process by the printing head H1001. The printing medium, which has undergone the printing process, is apt to be deformed during the process of drying, since the printing medium absorbs the ink after undergoing the printing process. In general, the deformation of the printing medium occurs in the form of the cockling or the curling. In the example shown in FIG. 12, the deformation of the printing medium occurs in the direction wherein the printing medium approaches the printing head H1001 (upward direction in the diagram). However, the behavior of the printing medium varies depending on various situations; for instance, the deformation of the printing medium can occur while parting from the printing head H1001 depending on the position or the pressure of the spur M2021. Anyway, such deformation of the printing medium causes the change in the distance between the printing head H1001 and the surface of the printing medium. Since such condition occurs during the drying process of the printing medium, such condition can hardly be prevented. Hence, it is necessary to take into consideration the possibility of the occurrence of such situation, although the effect of such situation has to be prevented as far as possible.

In the case of the transfer mechanism having the mechanism as is shown in FIG. 12, the pressure of the pinch roller M4014 is set larger than that of the spur M3014. Thus, the effect of the deformation of the printing medium entailing the change in the distance L between the optical sensor S1100 and the surface of the printing medium can be reduced by locating the optical sensor S1100 as close as possible to the pinch roller M3014. As discussed later, the present embodiment is designed so that the scanning operation by the optical sensor S1100 can be carried out in the position close to the pinch roller M3014.

Figure 13:
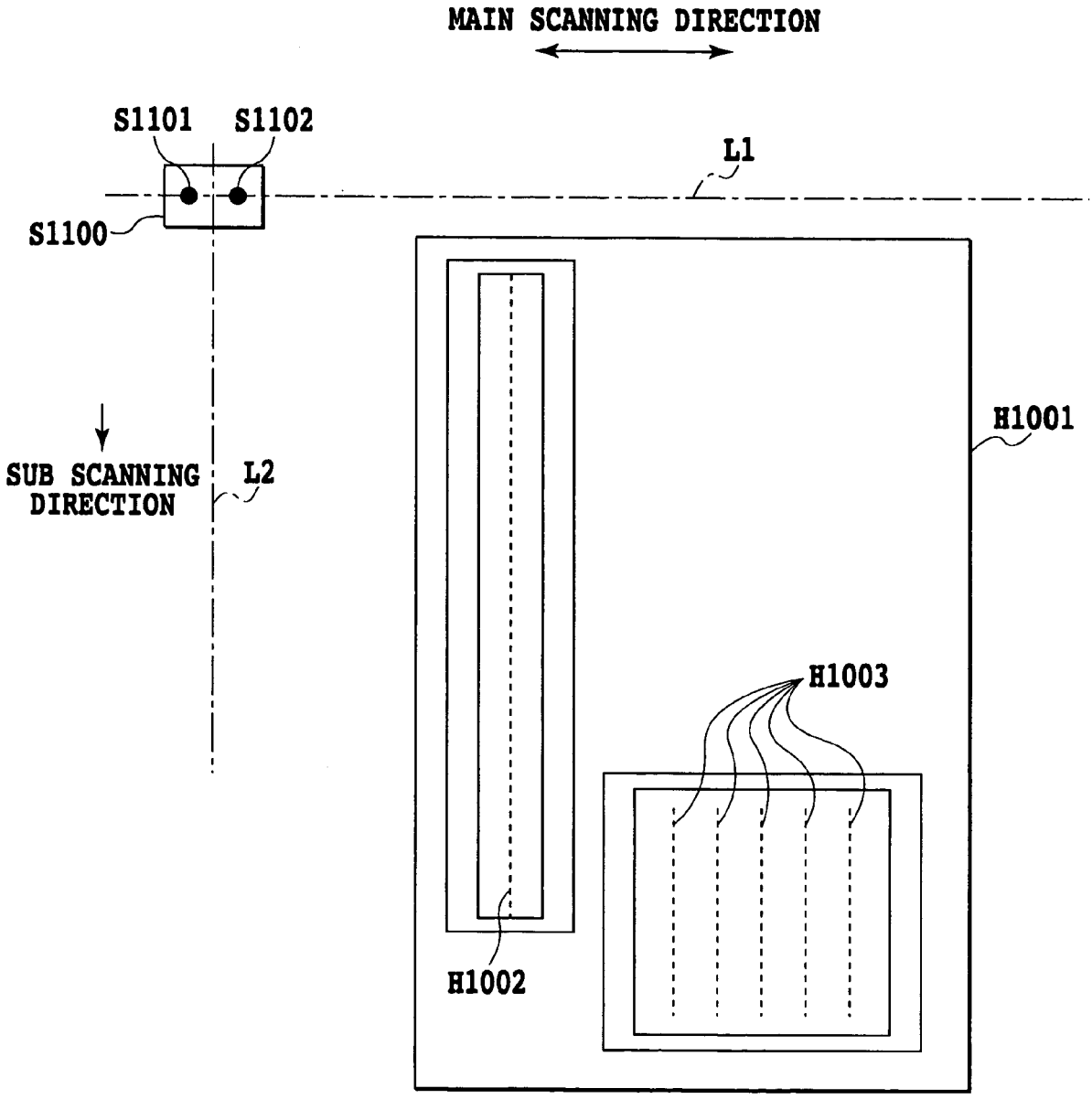
FIG. 13 is a diagram schematically illustrating the mounting location of the optical sensor according to the first embodiment of the present invention.

FIG. 13 is a diagram illustrating the positional relationship between the printing head H1001 on the carriage M4001 and the optical sensor S1100. In FIG. 13, upside corresponds to the upstream side of the transfer (paper sheet supplying side), while the downside corresponds to downstream side of the transfer (paper sheet discharging side).

The printing had H1101 is provided with Bk nozzles H1002 for ejecting the black (Bk) ink and color nozzles H1003 for ejecting the color inks (inks other than the black ink), and these nozzles are arrange in row respectively. The number of the nozzles and the number of the row of the nozzles may be of any number. Further, the nozzles H1002 and H1003 may be divided into groups to be mounted with a plurality of the printing heads H1001. In the case of the present embodiment, the location of the color nozzles H1003 and the location of the Bk nozzles are differentiated in the direction of the transfer of the printing medium so that the black ink dots can be formed before the formation of the color ink dots. Further, as the printing head H1001, inkjet printing head capable of ejecting ink from ink ejecting openings forming the nozzles can be used, and the piezoelectric element or the electrothermal element (heater) can be used as means for ejecting ink. When the electrothermal element is used, the ink can be boiled with the thermal energy of such element to eject the ink droplet from the nozzle by using bubbling energy of the ink.

The optical sensor S1100 is located by being offset a little from the printing head H1001 towards the paper sheet supplying side. Reference numeral L1 denotes a center line in the main scanning direction whereon the light emitter S1101 composed of the light emitting diode or the like and the light detector S1102 composed of the phototransistor or the like are arranged. Reference numeral L2 denotes a center line passing between the light emitter S1101 and the light detector S1102 and extending towards the sub scanning direction. In the case of the present embodiment, the light emitter S1101 and the light detector S1102 are located in parallel with each other in the main scanning direction, but they may be located in parallel with each other in the sub scanning direction. In any case, the effect of the present embodiment is obtained. Further, when the adjustment pattern is printed by using the color ink ejected from the color nozzle H1003, such adjustment pattern is located within the scanning range of the optical sensor 1100 after undergoing the printing process. In order to do so, the printing medium is fed backward so that the printing medium can be transferred in the direction reverse to the direction in the case of the ordinary printing operation. Then, the adjustment pattern is scanned with the optical sensor S1100. The similar process is applicable when the adjustment pattern is printed by using the color ink ejected from the Bk nozzle H1002.

Figure 14:
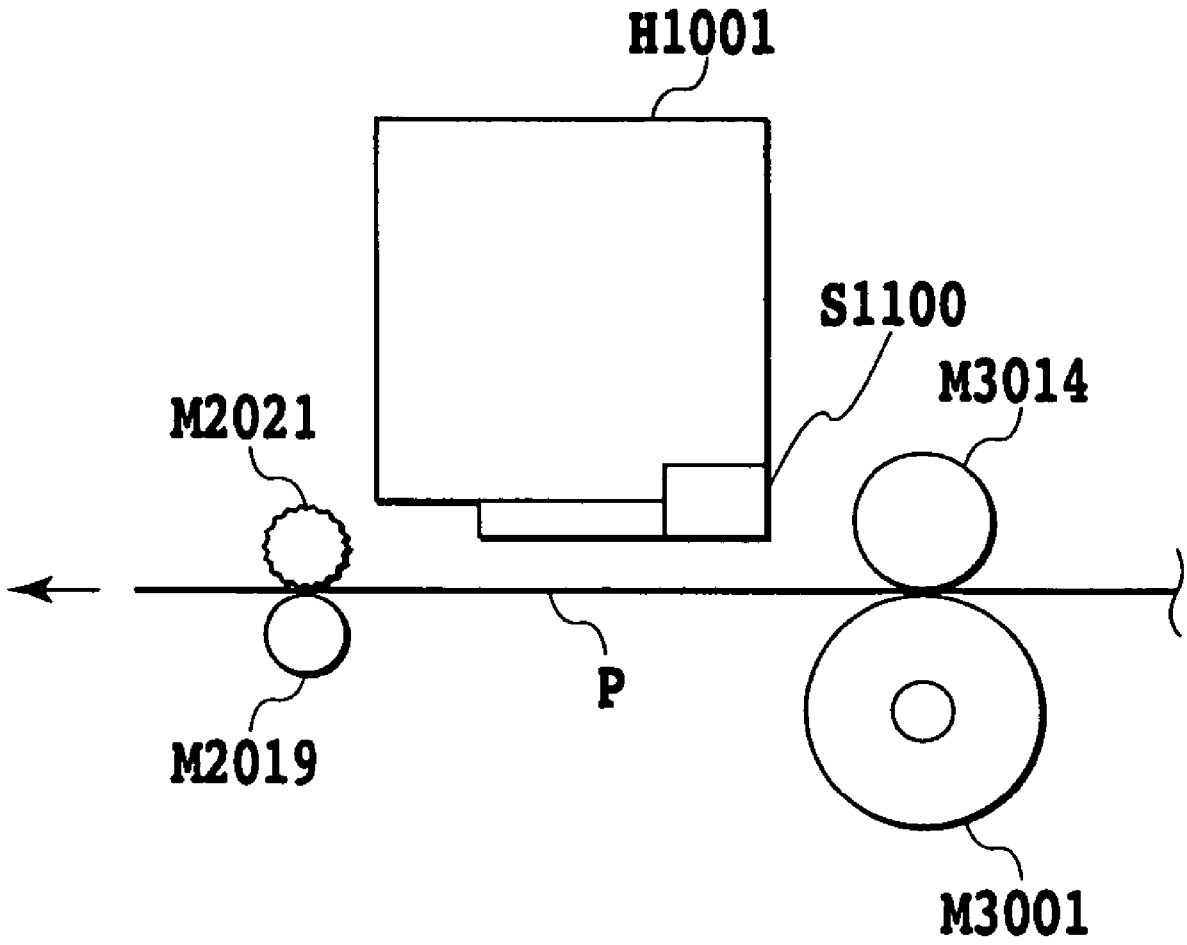
FIG. 14 is a side view showing the mounting location of the optical sensor according to the first embodiment of the present invention.

FIG. 14 is a diagram illustrating the composition of the printing medium transfer mechanism located in the vicinity of the optical sensor S1100 and the printing head H1001.

As seen from FIG. 14, the optical sensor S1100 is mounted on the carriage M4001 so as to be located closer to the pinch roller M3014 than the printing head H1001. Further, as described previously, the printing head H1001 is mounted on the carriage M4001. When the cockling or the like has occurred to the printing medium during the printing process of the adjustment pattern, in order to prevent the variation of the distance L (i.e., the distance to the surface of the paper sheet) owing to the effect of such deformation of the printing medium, the optical sensor S1100 is located close to the pinch roller M3014 capable of applying a relatively large pressure (restraining force). In consequence, the optical sensor S1100 is made to be able to scan the adjustment pattern printed on the printing medium with high accuracy in the vicinity of the pinch roller M3014 where the variation of the distance L is relatively small. In the case of the present embodiment, the dot alignment accuracy can be improved by combining such arrangement and the automatic dot alignment sequence shown in FIG. 10.

As discussed in the foregoing, in the inkjet printing apparatus according to the present embodiment incorporating the optical sensor and the automatic dot alignment process, when the automatic dot alignment process is carry out, it is avoided to be affected by the cockling or the like caused by printing the adjustment pattern on the printing medium. In order to obtain such effect sufficiently, the optical sensor is located in the vicinity of the paper hold-down mechanism (i.e., the pinch roller). Then, after printing the adjustment pattern on the printing medium, the printing medium is transferred backward to the adjustment pattern scanning position of the optical sensor to be scanned. With such a mechanism, the effect of the basic phenomenon such as the cockling, curling or the like occurring to the printing medium during the drying process of the ink used for the printing of the adjustment pattern can be prevented as far as possible. In consequence, the adjustment pattern can be scanned with the optical sensor with high accuracy so that the automatic dot alignment can be made with high accuracy too.

The Second Embodiment

Next, the second embodiment representing another characteristic of the present invention will be described.

In the transfer path of the printing medium as is shown in FIG. 4, the printing sheet P, as being a printing medium, is made to come between the LF roller (or paper supplying roller) M3001 and the pinch roller M3014 and also between the discharging roller (or paper discharging roller) M2019 and the spur M2021 and is supported with a rib-shape printing medium supporting face (hereinafter referred to as "rib") M2001*a* mounted on the platen M2001. Further, the printing sheet P comes to be pinched between the paper discharging spur M2023 and the rib M2001 in the main scanning direction. That is, the printing sheet P is held between the spurs M2023 and the ribs M2001*a* arranged alternately along the main scanning direction. Thus, the backside of the printing sheet P is pressed against the upsides (guiding side) of ribs M2001*a*, arranged at intervals in the main scanning direction, so that the printing sheet P before having the image printed thereon is placed at the printing position of the printing head H1001. On the other hand, the printing sheet P whereon the adjustment pattern is printed is apt to have the cockling or curling. Further, there is the possibility that the cockling occurs on the printing sheet P, whereon the adjustment pattern is printed, corresponding to the points where the printing sheet P is pressed against the ribs M2001*a* arranged at intervals in the main scanning direction.

Considering the characteristic of the printing sheet P being peculiar after having the adjustment pattern printed thereon, in order for the scanning accuracy of the optical sensor S1100 to be improved, it is desirable to enable the optical sensor S1100 to operate in a range being free from the influences of the ejection spurs M2023 and the ribs M2001*a*. In the arrangement shown in FIG. 4, it is preferable for the optical sensor S1100 to be located at the position offset towards the pinch rollers M3014 over the ribs M2001*a*. More specifically, the mounting location of the optical sensor S1100 is set above and between the two pairs of the ribs M2001*a*, located separately on the upstream side and the downstream side in the direction of the transfer of the printing sheet P, or set above and between the pair of the ribs M2001*a* located on the upstream side in the transfer direction of the printing sheet P and the LF roller M3001. By scanning the optical sensor S1100 in the main scanning direction at the position as described above, the optical sensor S1100 can be made capable of scanning the adjustment pattern with high accuracy without being affected by the cockling or the like of the printing sheet P.

As discussed above, in the case of the present embodiment, the mounting location of the optical sensor S1100 is set in consideration of the possibility that the change in the physical condition of the printing sheet P, having the adjustment pattern printed thereon, can occur along the main scanning direction owing to the presence of the ribs M2001*a*. In other words, by having the optical sensor S1100 carry out the scanning operation out of the range of the influence of the ribs M2001*a*, the adjustment pattern printed on the printing sheet P can be scanned with high accuracy. Other part of the composition of the system according to the present embodiment is similar to that of the first embodiment.

Another Embodiment

Figure 16:
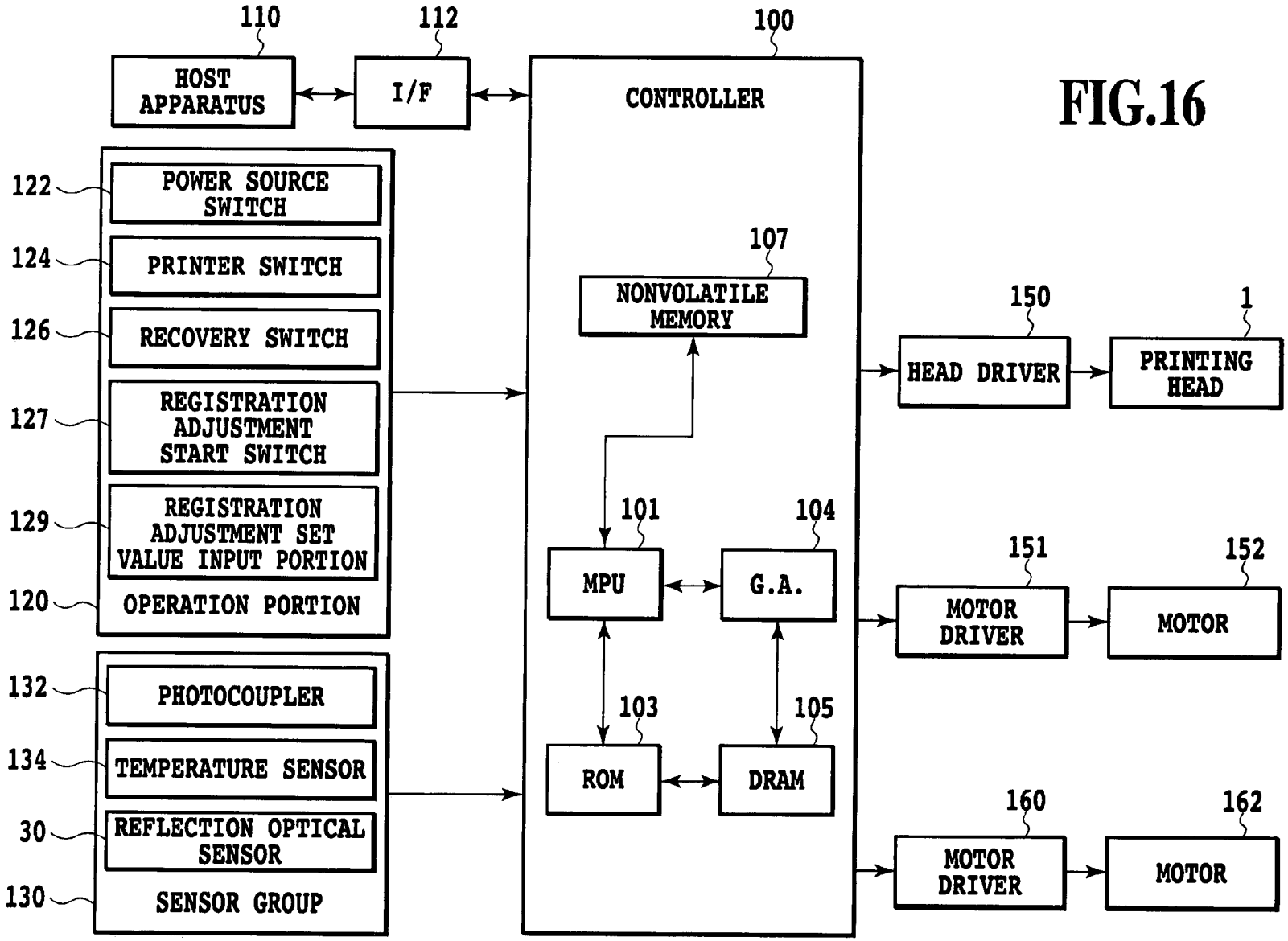
FIG. 16 is a block diagram illustrating another embodiment of the control system of a printing apparatus whereto the present invention is applicable.

FIG. 16 is a block diagram illustrating the control system of the printing apparatus whereto the present invention is applicable.

In this figure, a controller 100 is a main controller incorporating, for example, a microcomputer type MPU101. Reference numeral 103 denotes a ROM storing a program, necessary tables and other fixed data. Reference numeral 107 denotes a nonvolatile memory, such as the EEPROM, for storing the adjustment data obtained through the previously discussed dot alignment process and to be applied in actual printing process for matching the printing positions (printing position adjustment value). Reference numeral 105 denotes a dynamic RAM for storing various data (e.g., the printing signal, printing data to be supplied to the printing head or the like). The RAM 105 is capable of storing the information concerning the number of print dots, the number of times of the replacement of the printing head or the like. Reference numeral 104 denotes a gate array for controlling the supply of the data to the printing head 1 (the printing head H1001 in the case of the previously described embodiment), and this gate array is also capable of controlling the transmission of the data among an interface 112, the MPU 101 and the RAM 105. A host apparatus 110 is a source of the supply of the image data and may be used as the computer for creating and processing the image data relating to the desired printing. The host apparatus 110 may be used for functioning as the reader or the like for reading the images. The image data, the commands, status signals or the like are transmitted and received between the host apparatus 110 and the controller 100 through the interface (I/F) 112.

A controller 820 comprises a group of switches for receiving the inputs of the commands from the operator, the group of the switches comprising switches 122, 124, 126 and 127, and an input portion 129. The switch 122 is a power source switch; the switch 124 is a start switch for commanding the start of the printing operation; the switch 126 is a recovery switch for commanding the start of a suction recovery process of the printing head 1. The switch 127 is a registration start switch for starting the registration adjustment process before starting the registration. The input portion 129 is one for manually setting and inputting the registration adjustment value. A sensor group 130 is a group of the sensors comprising a reflection optical sensor 30 (the optical sensor S1100 in the case of the previously described embodiment), a photocoupler 132 for detecting a home position and a temperature sensor 134 provided at proper location for detecting the environmental temperature or the like. A head driver 150 is provided for driving an electrothermal converter (heater) in the printing head 1 according to the printing data or the like. The head driver 150 is provided with a timing setting portion for properly setting the drive timing (ejection timing) for the dot forming position alignment. Reference numeral 151 denotes a driver for driving the main scanning motor 4 for moving the carriage in the main scanning direction. Reference numeral 162 denotes a motor for transferring the printing medium 8 (the printing sheet P in the previously described embodiment) in the sub scanning direction, while 160 denotes a driver for driving the motor 162.

Another Embodiment

In the above-mentioned embodiment, the printing medium transfer mechanism functions as a positioning means for setting the position of the printing medium according to the printing position of the printing head and the scanning position of the optical sensor. As discussed previously, in the present invention, in consideration of the difference in the physical characteristic occurring between the printing medium before having the adjustment pattern printed thereon and the printing medium after having the adjustment pattern printed thereon, the scanning position of the optical sensor is set at the position situated near the specific position where the large restrictive force is generated for positioning the printing medium after having the adjustment pattern printed thereon. For instance, in the case of the previously described embodiment, the scanning position of the optical sensor is set in the vicinity of the pinch rollers M3014 where the holding force of the pinch rollers acting on the printing medium is large.

Further, after the adjustment pattern is printed on the printing medium by the printing head, it is desirable that the original state of the printing medium is maintained to a largest possible extent so that the printed adjustment pattern can be scanned with highest possible accuracy. In order to do so, the optical sensor needs to be located as close as possible to the printing head, as long as the optical sensor is not affected by the ink ejected from the printing head, thereby minimizing the transporting distance of the printing medium for positioning the printed adjustment pattern to the scanning position of the optical sensor from the printing position. Thus, in the case of the previous embodiment, the optical sensor is located at the position off set towards the pinch rollers M3014 from the printing head. If in the downstream side in the transfer direction of the printing medium, the large restrictive force is generated for positioning the printing medium after having the adjustment pattern printed thereon, the optical sensor may be located on the downstream side.

The present invention is applicable extensively to various types of printing apparatuses designed for printing the image by using the inks, and thus the application of the present invention is not limited to the inkjet printing apparatus. Further, as mentioned above, the present invention is also applicable to so-called full-line type printing apparatus characterized by using the long-size printing head covering the full width of the printing range of the printing medium. Further, the printing position adjustment pattern to be printed on the printing medium may take any form as long as being capable of providing the adjusting value applicable to the adjustment of the printing position by scanning the printed adjustment pattern and is not limited to those described in the foregoing embodiments of the present invention.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2003-313177 filed Sep. 4, 2003, which is hereby incorporated by reference herein.

What is claimed is:

1. A printing apparatus for printing on a printing medium by using a printing head for applying ink on the printing medium, said apparatus comprising:

pattern printing control means for printing a predetermined pattern on the printing medium;

an optical sensor located in the vicinity of said printing head in order to read the predetermined pattern printed on the printing medium;

positioning means for positioning the printing medium to a printing position by said printing head and a reading position by said optical sensor; and adjustment value setting means for setting an adjustment value for adjusting an applying position of the ink to be applied from said printing head based on a result of the reading by said optical sensor, wherein said positioning means includes a transfer mechanism for transferring the printing medium along a transfer path, wherein said transfer mechanism comprises a first roller pair located on an upstream side and a second roller pair located on a downstream side relative to said printing head in a transfer direction of the printing medium along the transfer path, wherein pressure in a nipping portion of said first roller pair is greater than pressure in a nipping portion of said second roller pair, wherein a first rib group of a plurality of ribs provided in the transfer path at intervals in a direction intersecting the transfer direction and a second rib group of the plurality of ribs provided in the transfer path at intervals in the direction intersecting the transfer direction are located between said first roller pair and said second roller pair in the transfer direction, wherein said first rib group is located on the upstream side and said second rib group is located on the downstream side relative to the printing head in the transfer direction, and wherein said optical sensor is located above a location between said first rib group and said second rib group in the transfer direction or a location between said first rib group and said first roller pair in the transfer direction.

2. The printing apparatus as claimed in claim 1, further comprising:

a carriage being able to mount said printing head and said optical sensor; and moving means for moving said carriage in a direction intersecting the transfer direction of the printing medium.

3. The printing apparatus as claimed in claim 1, further comprising printing control means for controlling printing by adjusting a printing position of said printing head on the basis of the adjustment value set by said adjustment value setting means.

4. The printing apparatus as claimed in claim 1, wherein the predetermined pattern is a printing position adjustment pattern for setting the adjustment value; and the printing position adjustment pattern is at least a pattern for obtaining the printing position adjustment value for adjusting a printing position in a forward printing and a printing position in a backward printing during a 2-way printing operation by said printing head, a pattern for obtaining the printing position adjustment values for adjusting printing positions of a plurality of printing heads applying different inks on the printing medium, or a pattern for obtaining the printing position adjustment values for adjusting printing positions of a plurality of printing heads for forming the ink dots varying in size on the printing medium.

5. The printing apparatus as claimed in claim 1, wherein said printing head has a plurality of rows of nozzles for ejecting the ink;

the predetermined pattern is a printing position adjustment pattern for setting the adjustment value; and the printing position adjustment pattern is a pattern for obtaining the printing position adjustment value for adjusting a printing position of an odd-number row among said plurality of nozzle rows and a printing position of an even-number row among said plurality of nozzle rows.

6. The printing apparatus as claimed in claim 1, wherein said printing head is an inkjet printing head capable of ejecting the ink.

7. The printing apparatus as claimed in claim 1, wherein said printing head can be moved in a scanning direction intersecting the transfer direction of the printing medium, and a position of said optical sensor and a position of said printing head do not overlap with each other in the scanning direction.

8. A printing position adjustment value setting method applicable to a printing apparatus for printing on a printing medium by using a printing head for applying ink on the printing medium, said method setting an adjustment value for adjusting a printing position of the printing head, said method comprising the steps of:

transporting the printing medium to a printing medium supporting face opposite to the printing head along a transfer path by using a transfer mechanism comprising a first roller pair located on an upstream side and a second roller pair located on a downstream side relative to the printing head in a transfer direction of the printing medium along the transfer path;

printing a predetermined pattern on the printing medium by using the printing head, after positioning the printing medium on the printing medium supporting face;

transporting the printing medium to a position opposite to an optical sensor;

reading the predetermined pattern printed on the printing medium by the optical sensor located in a vicinity of the printing head, after positioning the printing medium to the position opposite to the optical sensor; and setting the adjustment value for adjusting an applying position of the ink to be applied from the printing head based on a result of the reading by the optical sensor, wherein pressure in a nipping portion of the first roller pair is greater than pressure in a nipping portion of the second roller pair, wherein a first rib group of a plurality of ribs provided in the transfer path at intervals in a direction intersecting the transfer direction and a second rib group of the plurality of ribs provided in the transfer path at intervals in the direction intersecting the transfer direction are located between the first roller pair and the second roller pair in the transfer direction, wherein the first rib group is located on the upstream side and the second rib group is located on the downstream side relative to the printing head in the transfer direction, and wherein the optical sensor is located above a location between the first rib group and the second rib group in the transfer direction or a location between the first rib group and the first roller pair in the transfer direction.

9. A printing method for printing on a printing medium by using a printing head for applying ink on the printing medium, comprising the steps of:

transporting the printing medium to a printing medium supporting face opposite to the printing head along a transfer path by using a transfer mechanism comprising a first roller pair located on an upstream side and second roller pair located on a downstream side relative to the printing head in a transfer direction of the printing medium along the transfer path;

printing a predetermined pattern on the printing medium by using the printing head, after positioning the printing medium on the printing medium supporting face;

transporting the printing medium to a position opposite to an optical sensor;

reading the predetermined pattern printed on the printing medium by the optical sensor located in a vicinity of the printing head, after positioning the printing medium to the position opposite to the optical sensor;

setting the adjustment value for adjusting a printing position of the printing head; and performing the printing after adjusting an applying position of the ink to be applied from the printing head on the basis of the adjustment value set by said setting step, wherein pressure in a nipping portion of the first roller pair is greater than pressure in a nipping portion of the second roller pair, wherein a first rib group of a plurality of ribs provided in the transfer path at intervals in a direction intersecting the transfer direction and a second rib group of the plurality of ribs provided in the transfer path at intervals in the direction intersecting the transfer direction are located between the first roller pair and the second roller pair in the transfer direction, wherein the first rib group is located on the upstream side and the second rib group is located on the downstream side relative to the printing head in the transfer direction, and wherein the optical sensor is located above a location between the first rib group and the second rib group in the transfer direction or a location between the first rib group and the first roller pair in the transfer direction.

* * * * *